US010504355B2

(12) United States Patent
Wegelin et al.

(10) Patent No.: US 10,504,355 B2
(45) **Date of Patent: *Dec. 10, 2019**

(54) SENSOR CONFIGURATION

(71) Applicant: GOJO Industries, Inc., Akron, OH (US)

(72) Inventors: Jackson William Wegelin, Stow, OH (US); Bradley Lee Lightner, Canton, OH (US); Mark Adam Bullock, Wooster, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/895,359

(22) Filed: Feb. 13, 2018

(65) Prior Publication Data

US 2018/0240323 A1 Aug. 23, 2018

Related U.S. Application Data

(63) Continuation of application No. 14/599,643, filed on Jan. 19, 2015, now Pat. No. 9,892,617.

(Continued)

(51) Int. Cl.
*G08B 21/22* (2006.01)
*G08B 21/24* (2006.01)

(52) U.S. Cl.
CPC ..... *G08B 21/22* (2013.01); *G08B 21/245* (2013.01)

(58) Field of Classification Search
CPC ..... G08B 21/22; G08B 21/245
See application file for complete search history.

(56) References Cited

U.S. PATENT DOCUMENTS 6,323,941 B1 11/2001 Evans
6,426,701 B1 * 7/2002 Levy ..... G08B 21/24 137/552.7

(Continued)

FOREIGN PATENT DOCUMENTS

EP 0507025 B1 7/1997
EP 1258568 B1 2/2010
WO 97/25696 A1 7/1997

OTHER PUBLICATIONS

Int. Search Report cited in PCT Application No. PCT/US2015/011896 dated May 7, 2015, 11 pgs. Cited in Parent.

*Primary Examiner* — Joseph H Feild
*Assistant Examiner* — Rufus C Point
(74) *Attorney, Agent, or Firm* — Cooper Legal Group, LLC

(57) ABSTRACT

One or more techniques and/or systems are provided for detecting an object, such as a person. For example, a sensing system may comprise a sensor arrangement. The sensor arrangement may comprise a passive sensor and an active sensor. The active sensor may be placed into a sleep state (e.g., a relatively low powered state) until awakened by the passive sensor. For example, responsive to detecting a presence of an object (e.g., a nurse entering a patient's room), the passive sensor may awaken the active sensor from the sleep state to an active state for detecting motion and/or distance of the object within a detection zone to create object detection data (e.g., an indication of a hygiene opportunity for the nurse). The active sensor may transition from the active state to the sleep state responsive to a detection timeout and/or a determination that the object left the detection zone.

20 Claims, 22 Drawing Sheets

Related U.S. Application Data

(60) Provisional application No. 61/928,535, filed on Jan. 17, 2014.

(56) References Cited

U.S. PATENT DOCUMENTS 6,587,049 B1 * 7/2003 Thacker ..... G08B 5/00 340/330
7,227,893 B1 * 6/2007 Srinivasa ..... G06K 9/00771 348/155
7,398,944 B2 7/2008 Lewis
7,516,939 B2 4/2009 Bailey
7,523,885 B2 4/2009 Lewis
7,760,109 B2 * 7/2010 Broad ..... G08B 25/009 340/539.23
8,144,197 B2 * 3/2012 Broad ..... G08B 25/009 340/506
8,305,447 B1 * 11/2012 Wong ..... G08B 13/19602 348/151
8,378,820 B2 2/2013 Micko
8,786,481 B1 * 7/2014 Tzeng ..... H03M 7/30 341/155
8,810,408 B2 * 8/2014 Hanson ..... G08B 21/24 340/573.1
8,949,639 B2 * 2/2015 Kamhi ..... G06F 1/3287 713/320
9,070,267 B2 * 6/2015 Hanson ..... G08B 21/24
9,412,260 B2 * 8/2016 Kates ..... G08B 1/08
9,428,897 B2 * 8/2016 Le ..... E03C 1/057
9,442,017 B2 * 9/2016 Read ..... G01J 5/0025
9,594,361 B2 * 3/2017 Slupik ..... H04L 12/2816
2003/0135865 A1 * 7/2003 Jung ..... G08B 13/19656 725/105
2004/0061614 A1 * 4/2004 Sulaver ..... G08B 15/00 340/573.1
2005/0229654 A1 * 10/2005 Victor ..... E05B 73/00 70/58
2006/0063523 A1 * 3/2006 McFarland ..... G08C 17/02 455/423
2006/0067546 A1 * 3/2006 Lewis ..... G08B 21/245 381/124
2006/0144134 A1 * 7/2006 Kramer ..... B60C 23/0408 73/146
2006/0229086 A1 * 10/2006 Broad ..... G01D 21/00 455/456.1
2008/0224880 A1 * 9/2008 Valentine ..... G08B 3/10 340/686.6
2009/0092100 A1 * 4/2009 Lee ..... H04W 48/08 370/332
2009/0266842 A1 10/2009 Snodgrass
2010/0208068 A1 * 8/2010 Elsemore ..... A01M 31/002 348/143
2010/0315244 A1 * 12/2010 Tokhtuev ..... G08B 21/245 340/603
2011/0095892 A1 * 4/2011 Hong ..... A47F 9/04 340/572.7
2011/0102588 A1 * 5/2011 Trundle ..... G08B 13/196 348/143
2011/0163850 A1 * 7/2011 Bachman ..... G06K 19/0702 340/10.1
2011/0206378 A1 * 8/2011 Bolling ..... G16H 40/20 398/108
2012/0147531 A1 * 6/2012 Rabii ..... H04W 52/0254 361/679.01
2012/0313785 A1 * 12/2012 Hanson ..... G08B 21/24 340/573.1
2012/0327242 A1 * 12/2012 Barley ..... H04N 5/232 348/155
2013/0215266 A1 * 8/2013 Trundle ..... G08B 13/19602 348/143
2013/0229263 A1 * 9/2013 Graczyk ..... G01S 1/70 340/10.1
2014/0077988 A1 * 3/2014 Saito ..... G01S 7/41 342/27
2014/0354435 A1 * 12/2014 Hanson ..... G08B 21/24 340/573.1
2015/0105911 A1 * 4/2015 Slupik ..... H04L 12/2816 700/275
2015/0167280 A1 * 6/2015 Le ..... E03D 5/105 251/129.04
2016/0105644 A1 * 4/2016 Smith ..... H04N 5/23206 348/159
2016/0189501 A1 * 6/2016 Hu ..... G08B 13/19602 348/152

* cited by examiner

SENSOR CONFIGURATION

RELATED APPLICATION

This application is a continuation of and claims priority to U.S. patent application Ser. No. 14/599,643, titled "SENSOR CONFIGURATION" and filed on Jan. 19, 2015, which is itself a non-provisional filing of and claims priority to U.S. Provisional Application No. 61/928,535, titled "SENSOR CONFIGURATION" and filed on Jan. 17, 2014. U.S. applications Ser. Nos. 14/599,643 and 61/928,535 are incorporated herein by reference in their entirety.

TECHNICAL FIELD

The instant application is generally directed towards sensing systems for detecting an object, such as a person. For example, the instant application is directed to methods and/or systems for detecting an object, such as a healthcare worker, to identify a hygiene opportunity for the healthcare worker.

BACKGROUND

Many locations, such as hospitals, factories, restaurants, homes, etc., may implement various hygiene and/or disease control policies. For example, a hospital may set an 85% hygiene compliance standard for a surgery room. A hygiene opportunity may correspond to a situation or scenario where a person should perform a hygiene event, such as using a hand sanitizer or washing their hands. Compliance with the hygiene opportunity may increase a current hygiene level, while non-compliance may decrease the current hygiene level. In an example of monitoring hygiene, a hygiene dispenser may be monitored by measuring an amount of material, such as soap, lotion, sanitizer, etc., consumed or dispensed from the dispensing system. However, greater utilization of the hygiene dispenser may not directly correlate to improved hygiene (e.g., medical staff may inadvertently use the hygiene dispenser for relatively low transmission risk situations as opposed to relatively high transmission risk situations, such as after touching a high transmission risk patient in a surgery room).

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

Among other things, one or more systems and/or techniques for detecting an object are provided herein. In an example, a sensing system comprises a sensor arrangement. The sensor arrangement comprises a passive sensor and an active sensor. The passive sensor may be configured to detect a presence of an object. For example, the passive sensor may detect a nurse walking into a patient's room based upon infrared radiation emitted from the nurse due to body heat of the nurse (e.g., the passive sensor may detect a change in temperature from an ambient temperature, such that if the change in temperature exceeds a threshold difference, then the passive sensor may determine that an object is present). The passive sensor may operate utilizing relatively lower power consumption (e.g., the passive sensor may operate utilize a battery). Because the passive sensor may be relatively inaccurate, the passive sensor may be configured to send a wakeup signal to the active sensor responsive to passive sensor detecting the presence of the object. The active sensor is awakened to measure motion and/or distance of the object because the active sensor may be relatively more accurate than the passive sensor. The sensor arrangement may comprise one or more passive sensors and one or more active sensors. In an example, the sensor arrangement may comprise a passive sensor configured to awaken a plurality of active sensors. In another example, the sensor arrangement may comprise a plurality of passive sensors configured to awaken an active sensor. In another example, the sensor arrangement may comprise a plurality of passive sensors that are configured to awaken a plurality of active sensors.

Because operation of the active sensor may use a relatively larger amount of power, the active sensor may be configured to be in a sleep state (e.g., a relatively lower power state) until awakened by the passive sensor. For example, responsive to receiving the wakeup signal from the passive sensor, the active senor may transition from the sleep state to an active state. While in the active state, the active sensor may detect motion and/or distance of the object within a first detection zone to create object detection data. For example, an emitter may send out one or more signals (e.g., photons, a light pulse, parallel beams, triangulated beams, ultrasound, an RF signal, infrared, etc.) that may reflect off the object and are detected by a receiver (e.g., a photodiode, an array of photodiodes, a time of flight measurement device, etc.). It may be appreciated that an active sensor may comprise any sensing device, such as a time of flight device (e.g., a device that measures a time of flight based upon an arrival time difference between a first signal, such as an ultrasound signal, and a second signal, such as an RF signal), a camera device, an infrared device, a radar device, a sound device, etc. In an example, one or more detection zones may be defined (e.g., a left bedside zone to the left of a patient bed zone and a right bedside zone to the right of the patient bed zone that are to be monitored) and/or one or more non-detection zones (e.g., the patient bed zone that is not to be monitored) may be defined based upon distance metrics. Responsive to a detection timeout (e.g., 10 seconds) and/or a determining that the object has left the first detection zone (e.g., the nurse may have left the left bedside), the active sensor may transition from the active state to the sleep state. In this way, the sensor arrangement may provide accurate detection of objects (e.g., indicative of a hygiene opportunity, such as an opportunity for the nurse to wash his hands after interacting with a patient) while operating at relatively lower power states because the active sensor is in the sleep state until awakened by the passive sensor.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

Figure 1:
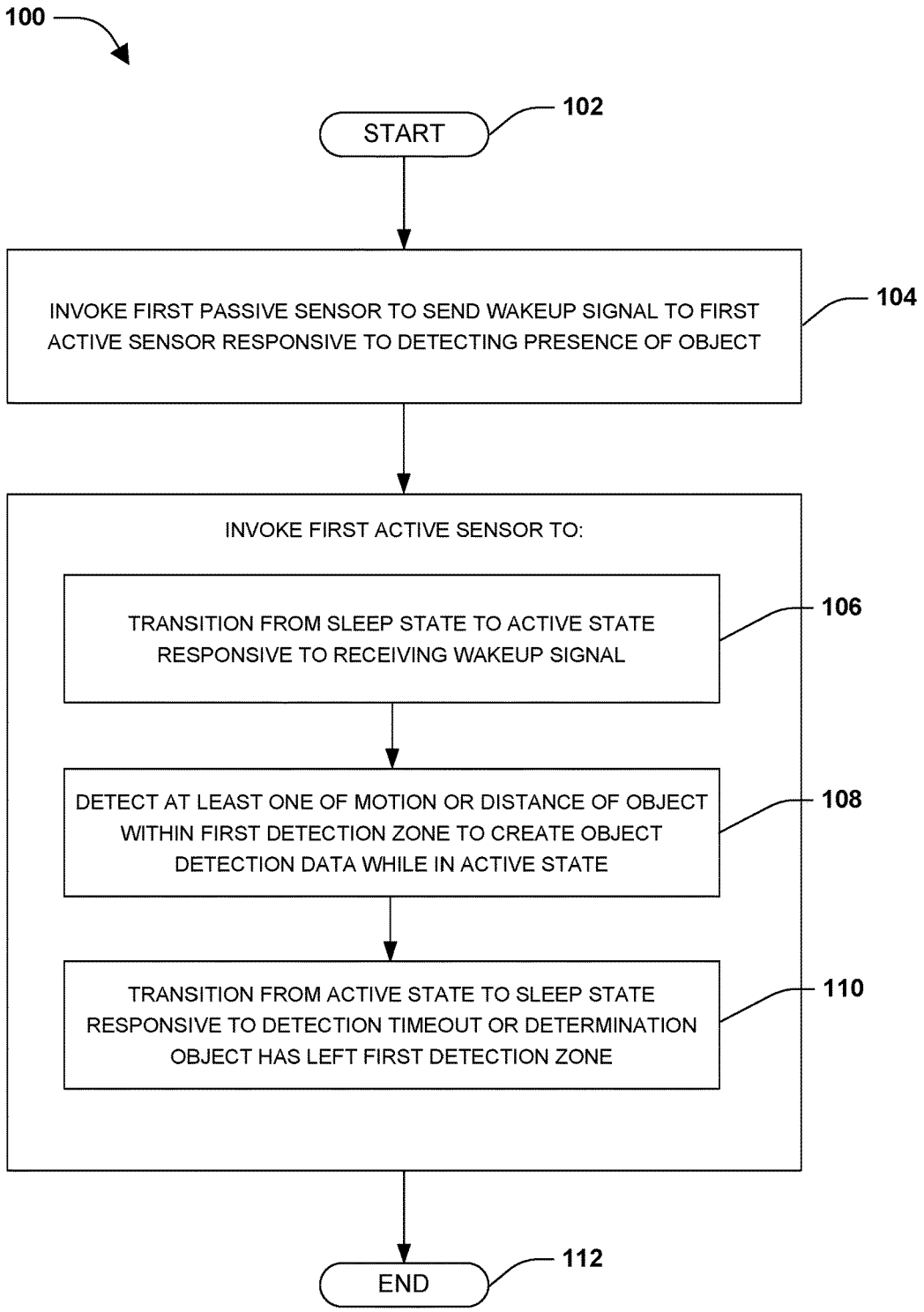
FIG. 1 is a flow diagram illustrating an exemplary method of detecting an object.

The claimed subject matter is now described with reference to the drawings, wherein like reference numerals are generally used to refer to like elements throughout. In the following description, for purposes of explanation, numerous specific details are set forth in order to provide an understanding of the claimed subject matter. It may be evident, however, that the claimed subject matter may be practiced without these specific details. In other instances, structures and devices are illustrated in block diagram form in order to facilitate describing the claimed subject matter.

An embodiment of detecting an object is illustrated by an exemplary method 100 of FIG. 1. At 102, the method starts. At 104, a first passive senor (e.g., a passive infrared sensor) is invoked to send a wakeup signal to a first active sensor (e.g., an active infrared sensor, such as a position sensitive device, a parallel sensor, a triangulated sensor, a time of flight distance sensor, etc.) responsive to detecting a presence of an object. For example, the first passive sensor may detect a temperature difference above a threshold difference from an ambient temperature based upon infrared radiation emitted from a person entering a room.

At 106, the first active sensor may be invoked to transition from a sleep state (e.g., a relatively low powered state) to an active state (e.g., an emitter of the first active sensor may send out one or more signals towards a detection zone, which may reflect off the object for detection by a receiver of the first active sensor) responsive to receiving the wakeup signal from the first passive sensor. At 108, while in the active state, the first active sensor may detect motion and/or distance of the object within one or more detection zones, such as a first detection zone (e.g., a bedside zone, a doorway zone, a hygiene zone, a hygiene opportunity zone, a person count zone, etc.), to create object detection data. A hygiene opportunity and/or other information (e.g., a person count, a security breach, etc.) may be identified based upon the object detection data. The object detection data may be stored, transmitted over a network, transmitted through an RF signal, and/or used to activate an indicator (e.g., blink a light, display an image such a hand washing image, play a video such as a hygiene video, play a recording such as hygiene requirements for the first detection zone, etc.). At 110, responsive to a detection timeout (e.g., 8 seconds) and/or a determination that the object has left the first detection zone, the active sensor may be transitioned from the active state to the sleep state to preserve power consumption. In this way, the active sensor provides relatively accurate detection information without unnecessary consumption of power because the active sensor is retained in the low power sleep state until awakened by the passive sensor. At 112, the method ends.

Figure 2A:
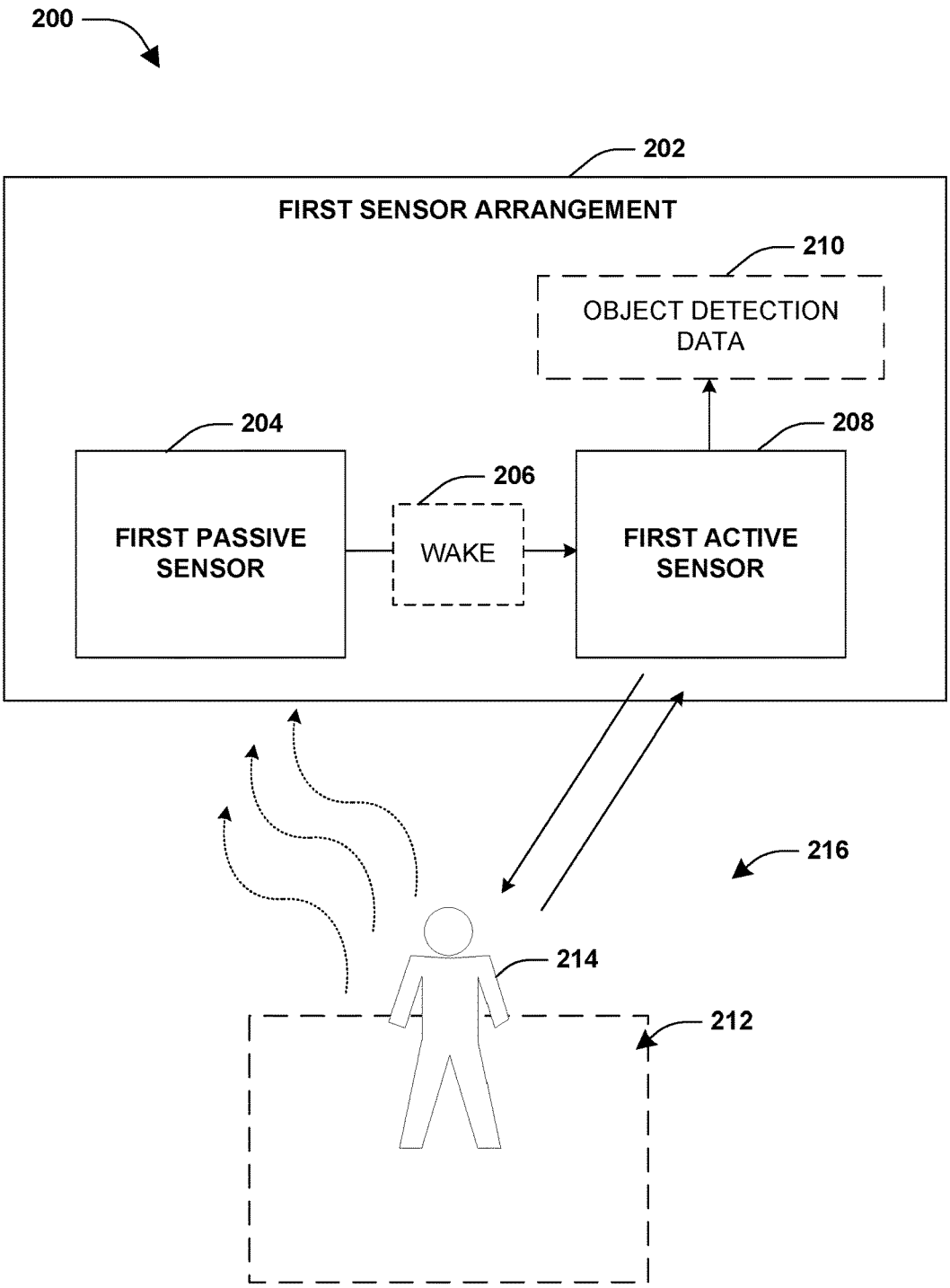
FIG. 2A is a component block diagram illustrating an exemplary sensing system comprising a first sensor arrangement.

FIG. 2A illustrates an example of a sensing system 200 comprising a first sensor arrangement 202. The first sensor arrangement 202 may comprise a first passive sensor 204 (e.g., a passive infrared sensor) and/or a first active sensor 208 (e.g., an active infrared sensor, such as a position sensitive device, a parallel sensor, a triangulated sensor, a flight of flight distance sensor, etc.). In an example, the first sensor arrangement 202 may comprise a microcontroller, not illustrated, configured to control operation of the first passive sensor 204 and/or the first active sensor 208 (e.g., the microcontroller may place the first active sensor 208 into a sleep state or an active state; the microcontroller may store, process, and/or communicate object detection data 210 collected by the first active sensor 208; etc.). In an example, the first passive sensor 204 and the first active sensor 208 may be comprised within a sensor housing. The passive sensor 204 may be configured to detect a presence of an object (e.g., the first passive sensor 204 may detect a temperature change from an ambient temperature based upon infrared radiation emitted by a person 214). Responsive to detecting the person 214, the first passive sensor 204 may send a wakeup signal 206 to the first active sensor 208 (e.g., which may be in a sleep state to conserve power, such as a battery that supplies power to the first sensor arrangement 202).

The first active sensor 208 may be configured to transition from the sleep state to an active state responsive to receiving the wakeup signal 206 from the first passive sensor 204 (e.g., the microcontroller may receive the wakeup signal 206 from the first passive sensor 204, and may instruct the first active sensor 208 to begin detecting). While in the active state, the first active sensor 208 may detect motion and/or distance of the person 214 within a first detection zone 212 to create object detection data 210. In an example, the first detection zone 212 may be defined based upon a first set of detection distance metrics (e.g., defining an entryway to a room such as a kitchen or bathroom). In another example, the first active sensor 208 may ignore a non-detection zone defined based upon a first set of non-detection distance metrics (e.g., defining non-entryway portions of the room). The first sensor arrangement 202 may be configured to store the object detection data 210 within data storage of the first sensor arrangement 202, transmit the object detection data 210 over a communication network, transmit the object detection data 210 as an RF signal, and/or activate an indicator (e.g., blink a light, display an image, play a video, play a recording, etc.). In an example, the first sensor arrangement 202 may be configured to identify a hygiene opportunity based upon the object detection data 210 (e.g., the person 214 may have an opportunity to sanitize while in the room). In another example, the first sensor arrangement 202 may be configured to identify the person 214 as entering and/or leaving the room based upon the object detection data 210 (e.g., identification of a person count).

Figure 2B:
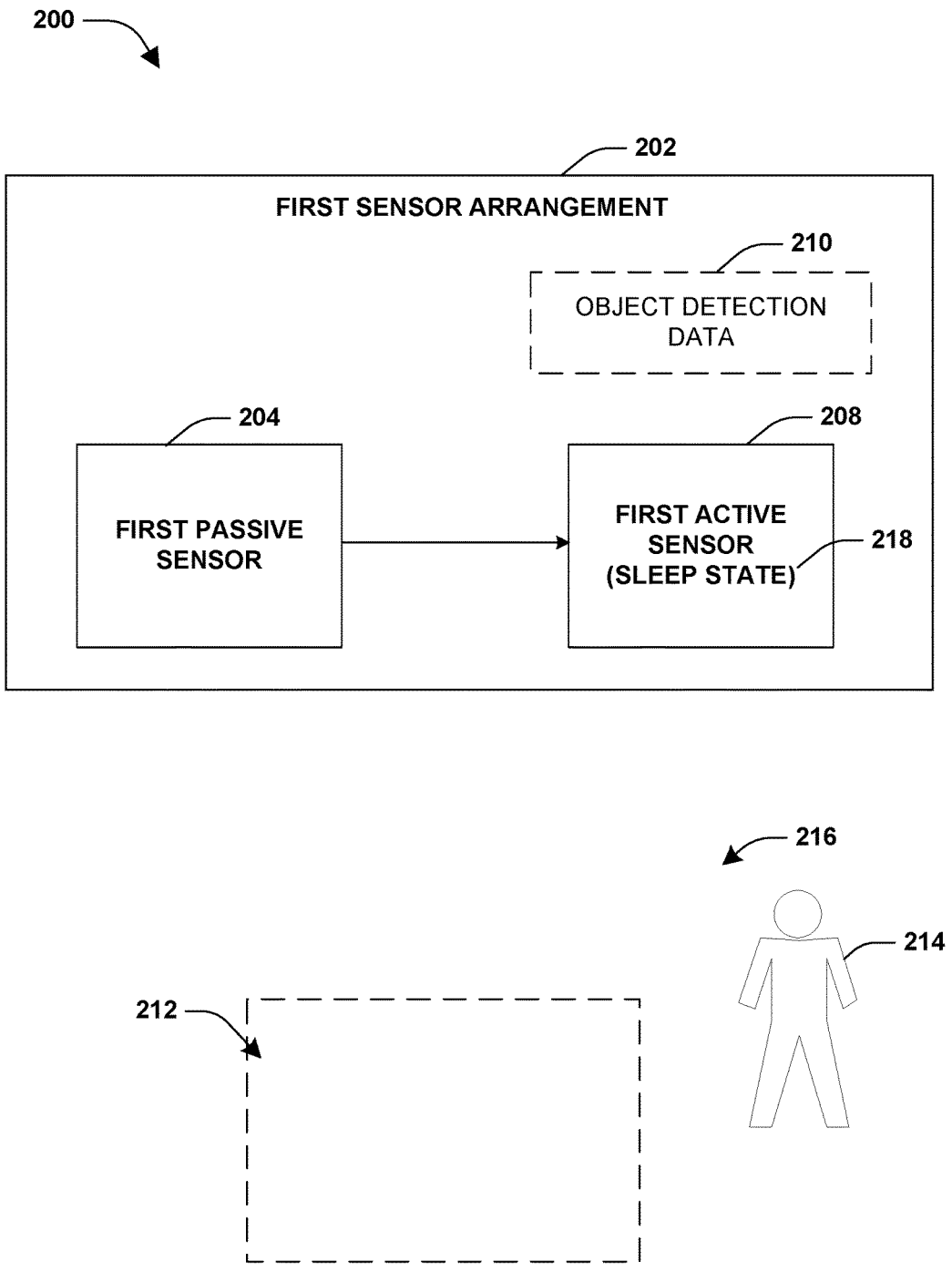
FIG. 2B is an illustration of an example of a first active sensor of a first sensor arrangement transitioning from an active state to a sleep state.

FIG. 2B illustrates an example a first active sensor 208 of a first sensor arrangement 202 transitioning from an active state to a sleep state 218. In an example, the first active sensor 208 may have been awakened into the active state by a first passive sensor 204 so that the first active sensor 208 may detect a person 214 within a first detection zone 212, as illustrated in FIG. 2A. The first active sensor 208 may determine that the person 214 has left the first detection zone 212 (e.g., the person 214 may have walked into a non-detection zone 216). Accordingly, the first active sensor 208 may transition from the active state to the sleep state 218 to conserve power consumption by the first sensor arrangement 202.

Figure 3A:
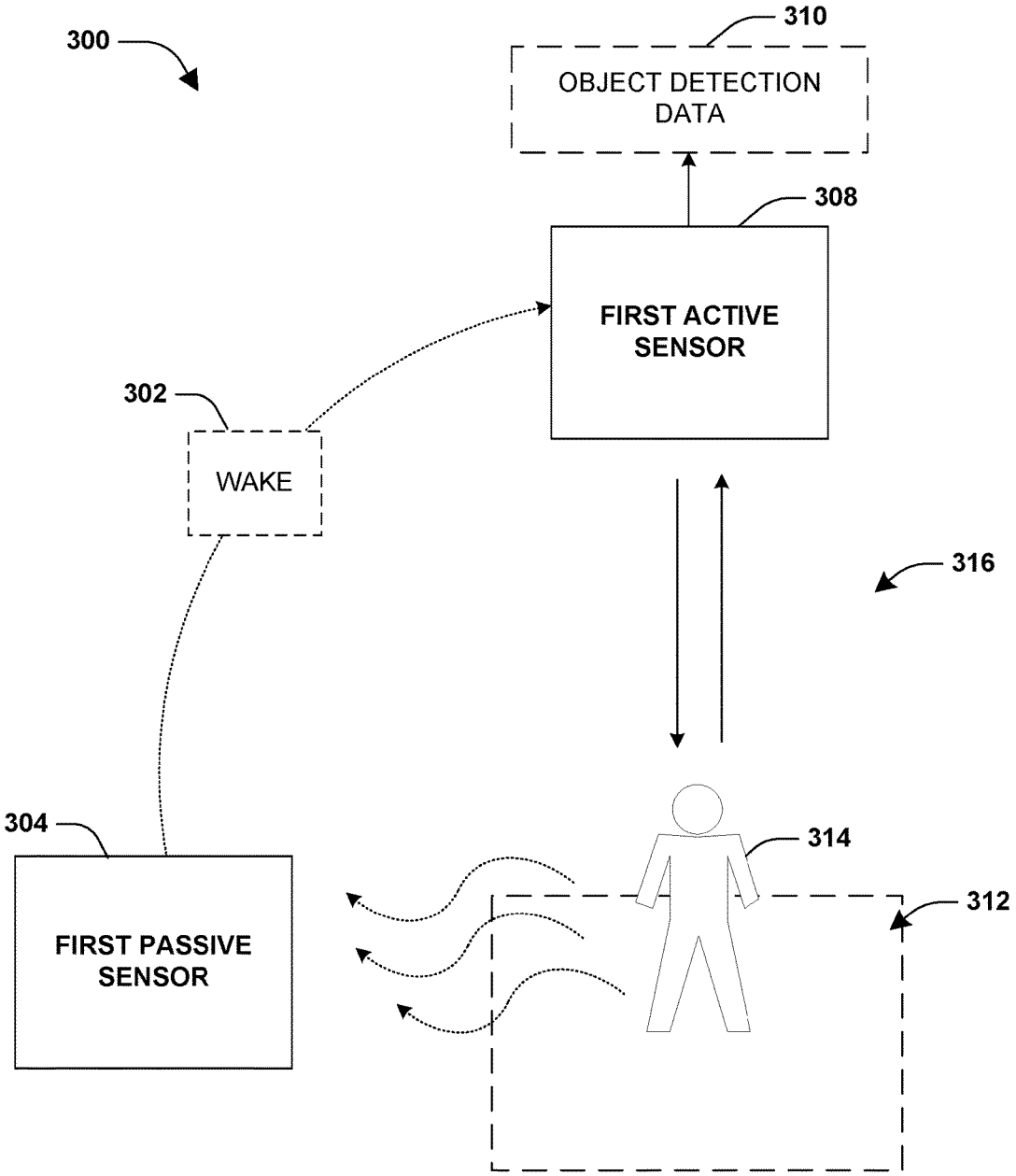
FIG. 3A is a component block diagram illustrating an exemplary sensing system for detecting an object.

FIG. 3A illustrates an example of a sensing system 300 for detecting an object. The sensing system 300 may comprise a first passive sensor 304 and a first active sensor 308. In an example, the first passive sensor 304 is comprised within a first sensor housing. The first active sensor 308 is comprised within a second sensor housing remote to the first sensor housing. In this way, the first active sensor 308 may be placed in a remote location different than a location of the first passive sensor 304. Responsive to detecting a presence of the object, such as a person 314, the first passive sensor 304 may be configured to send a wakeup signal 302 (e.g., a RF signal) to the first active sensor 308. Responsive to receiving the wakeup signal 302, the first active sensor 308 may be configured to transition from a sleep state to an active state. While in the active state, the first active sensor 308 may detect motion and/or distance of the person 314 within a first detection zone 312 to create object detection data 310 (e.g., a person count). In an example, the first active sensor 308 may ignore a first non-detection zone 316.

Figure 3B:
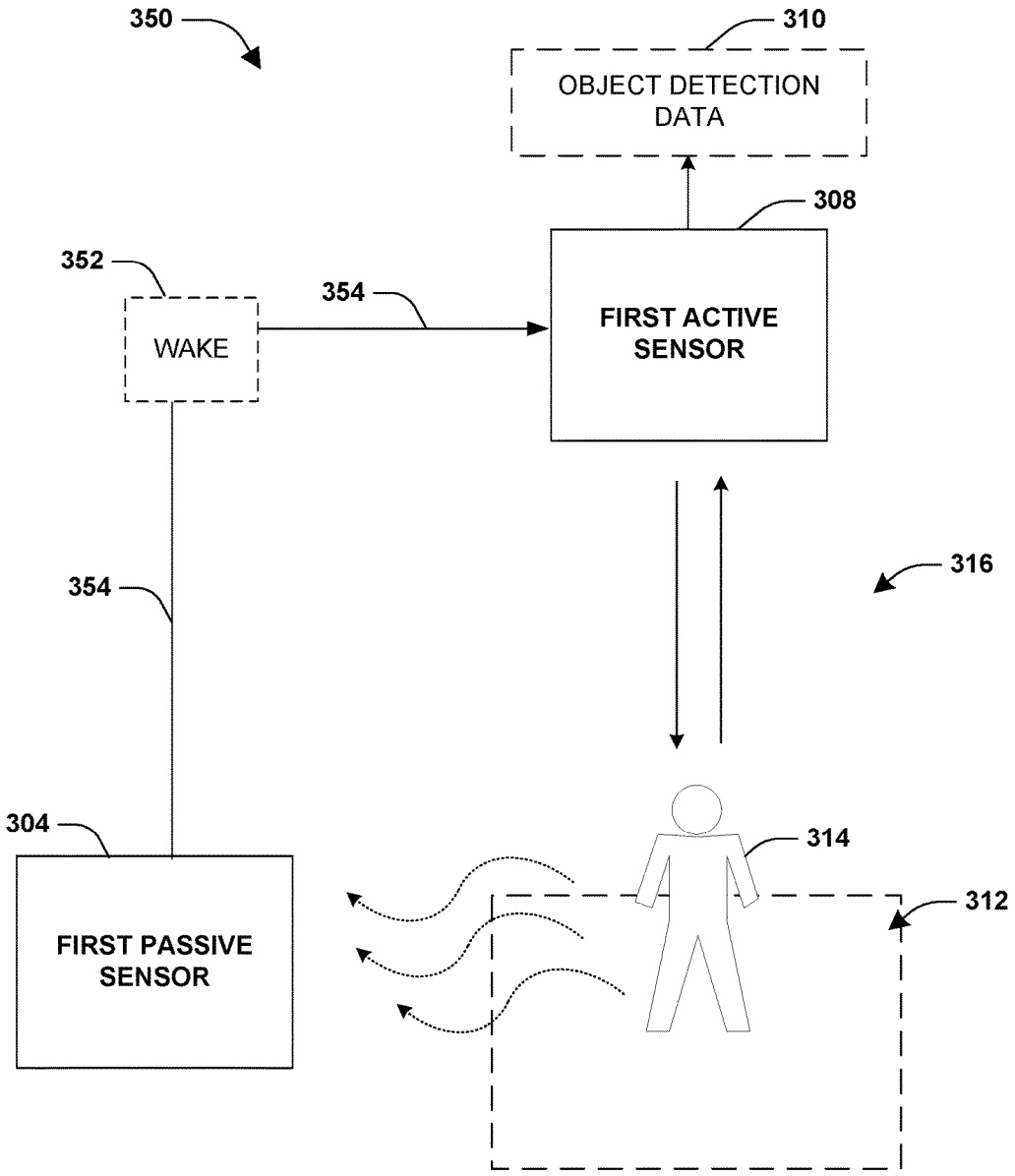
FIG. 3B is a component block diagram illustrating an exemplary sensing system for detecting an object.

FIG. 3B illustrates an example of a sensing system 350 for detecting an object. The sensing system 350 may comprise a first passive sensor 304 and a first active sensor 308. In an example, the first passive sensor 304 is comprised within a first sensor housing. The first active sensor 308 is comprised within a second sensor housing remote to the first sensor housing. In an example, the first passive sensor 304 is connected by a connection 354 (e.g., a wire, a network, etc.) to the first active sensor 308. In this way, the first active sensor 308 may be placed in a remote location different than a location of the first passive sensor 304. Responsive to detecting a presence of the object, such as a person 314, the first passive sensor 304 may be configured to send a wakeup signal 352 over the connection 354 to the first active sensor 308. Responsive to receiving the wakeup signal 352, the first active sensor 308 may be configured to transition from a sleep state to an active state. While in the active state, the first active sensor 308 may detect motion and/or distance of the person 314 within a first detection zone 312 to create object detection data 310 (e.g., a person count). In an example, the first active sensor 308 may ignore a first non-detection zone 316.

Figure 3C:
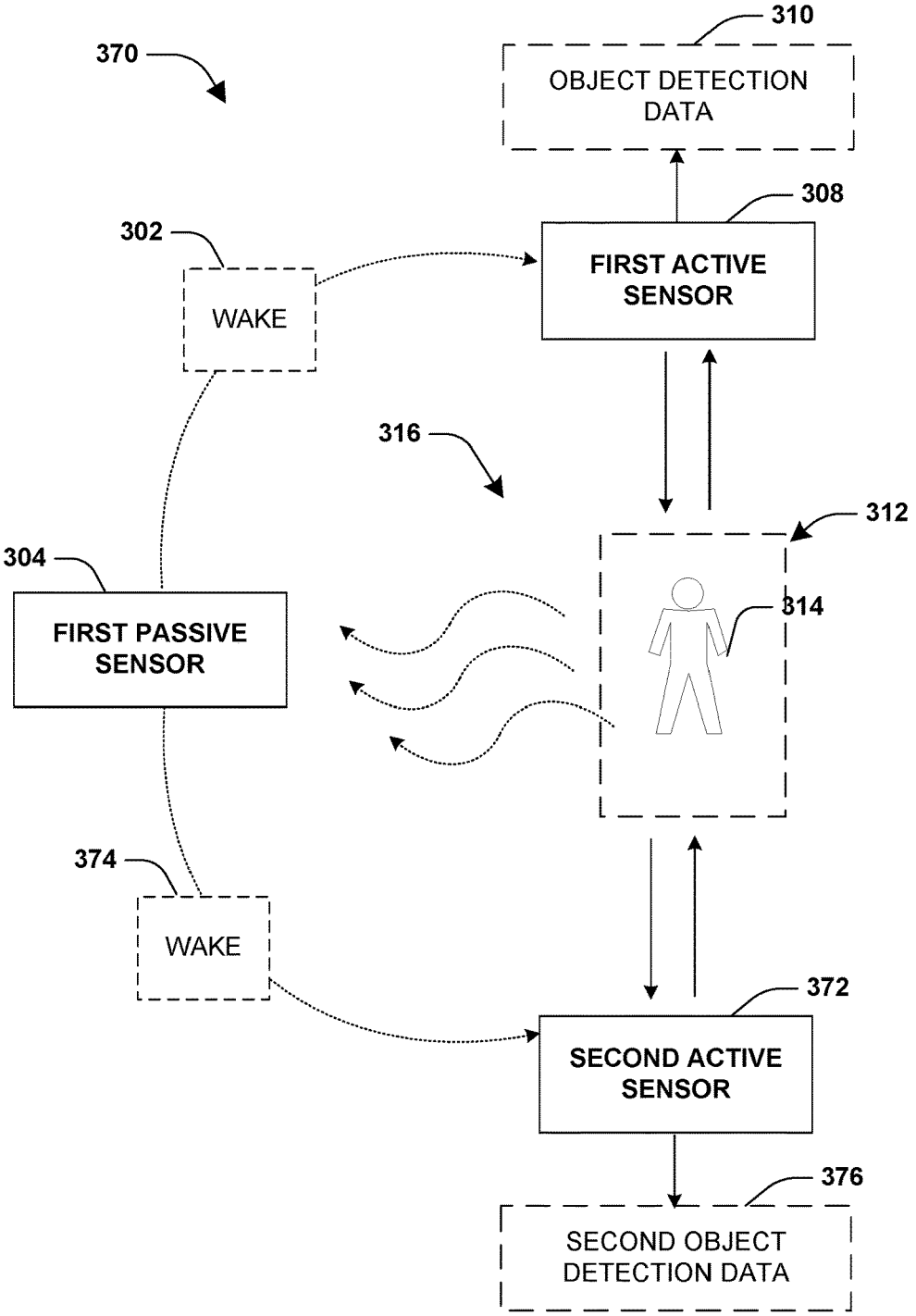
FIG. 3C is a component block diagram illustrating an exemplary sensing system for detecting an object.

FIG. 3C illustrates an example of a sensing system 370 for detecting an object. The sensing system 370 may comprise a first passive sensor 304, a first active sensor 308, a second active sensor 372, and/or other active sensors not illustrated. In an example, the first passive sensor 304 is comprised within a first sensor housing. The first active sensor 308 is comprised within a second sensor housing remote to the first sensor housing. The second active sensor 372 is comprised within a third sensor housing remote to the first sensor housing and/or the second sensor housing. In this way, the first active sensor 308 and/or the second active sensor 372 may be placed in remote locations different than a location of the first passive sensor 304. Responsive to detecting a presence of the object, such as a person 314, the first passive sensor 304 may be configured to send a wakeup signal 302 (e.g., a first RF signal) to the first active sensor 308 and/or a second wakeup signal 374 (e.g., a second RF signal) to the second active sensor 372. Responsive to receiving the wakeup signal 302, the first active sensor 308 may be configured to transition from a sleep state to an active state. While in the active state, the first active sensor 308 may detect motion and/or distance of the person 314 within a first detection zone 312 (e.g., and/or other detection zones configured for the first active sensor 378 to detect) to create object detection data 310. In an example, the first active sensor 308 may ignore a first non-detection zone 316. Responsive to receiving the second wakeup signal 374, the second active sensor 372 may be configured to transition from a second sleep state to a second active state. While in the second active state, the second active sensor 372 may detect motion and/or distance of the person 314 within the first detection zone 312 (e.g., and/or other detection zones configured for the second active sensor 372 to detect) to create second object detection data 376. In an example, the second active sensor 372 may ignore the first non-detection zone 316.

Figure 3D:
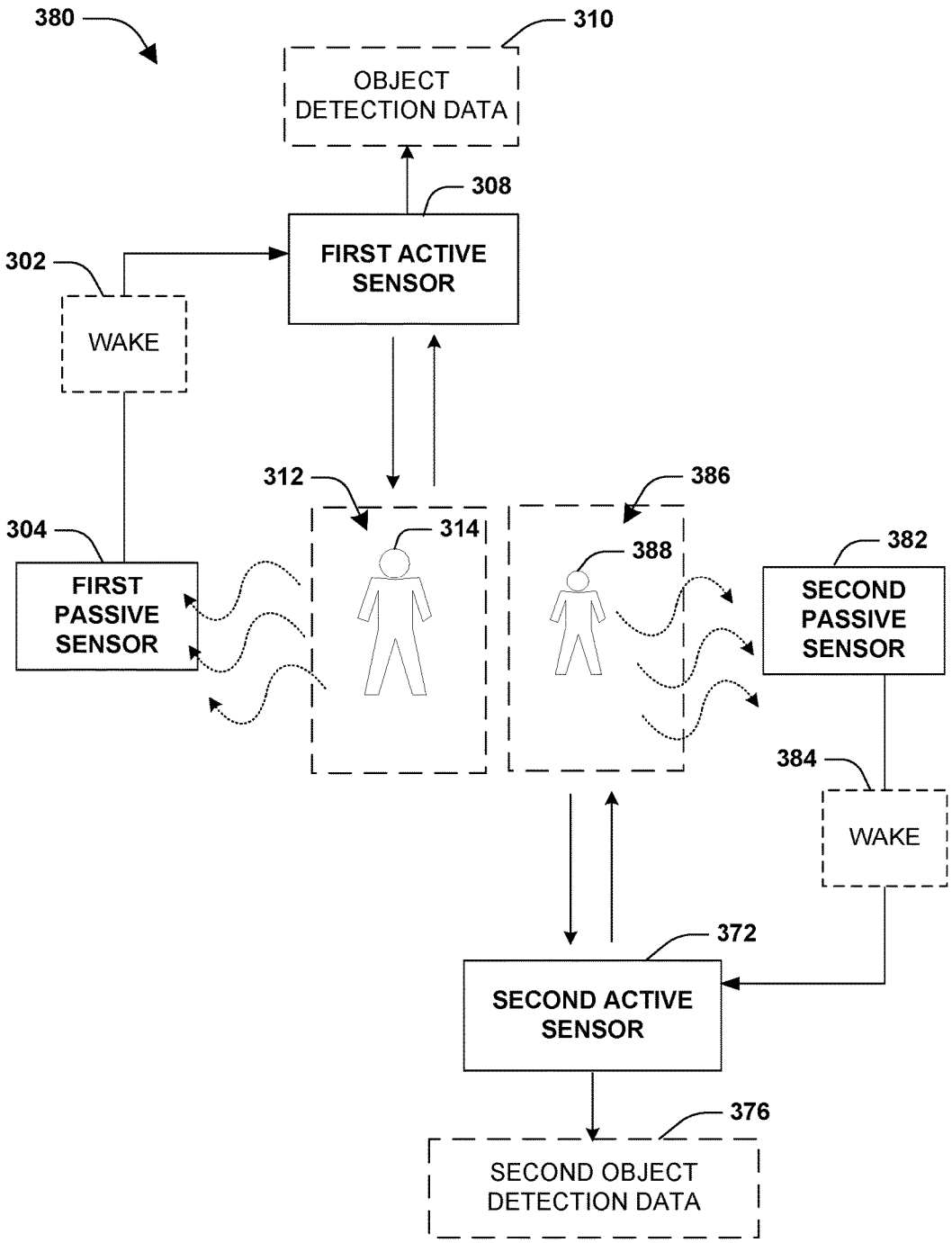
FIG. 3D is a component block diagram illustrating an exemplary sensing system for detecting an object.
Figure 3E:
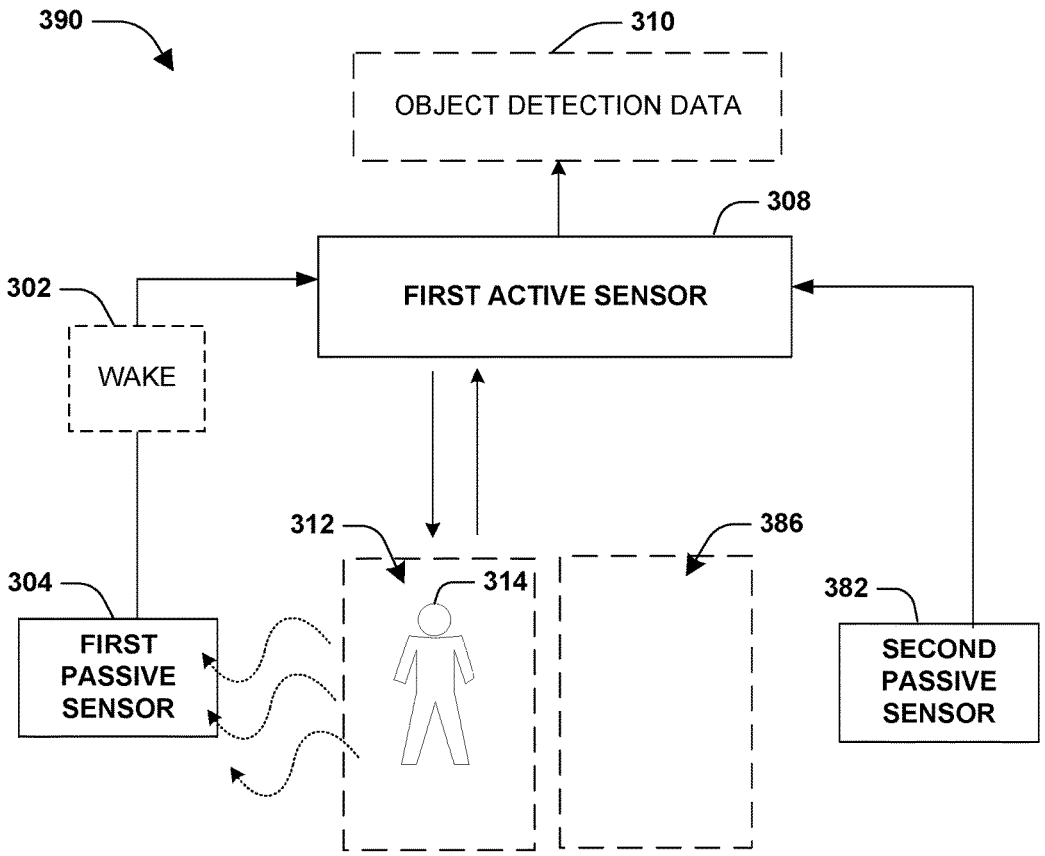
FIG. 3E is a component block diagram illustrating an exemplary sensing system for detecting an object.
Figure 3F:
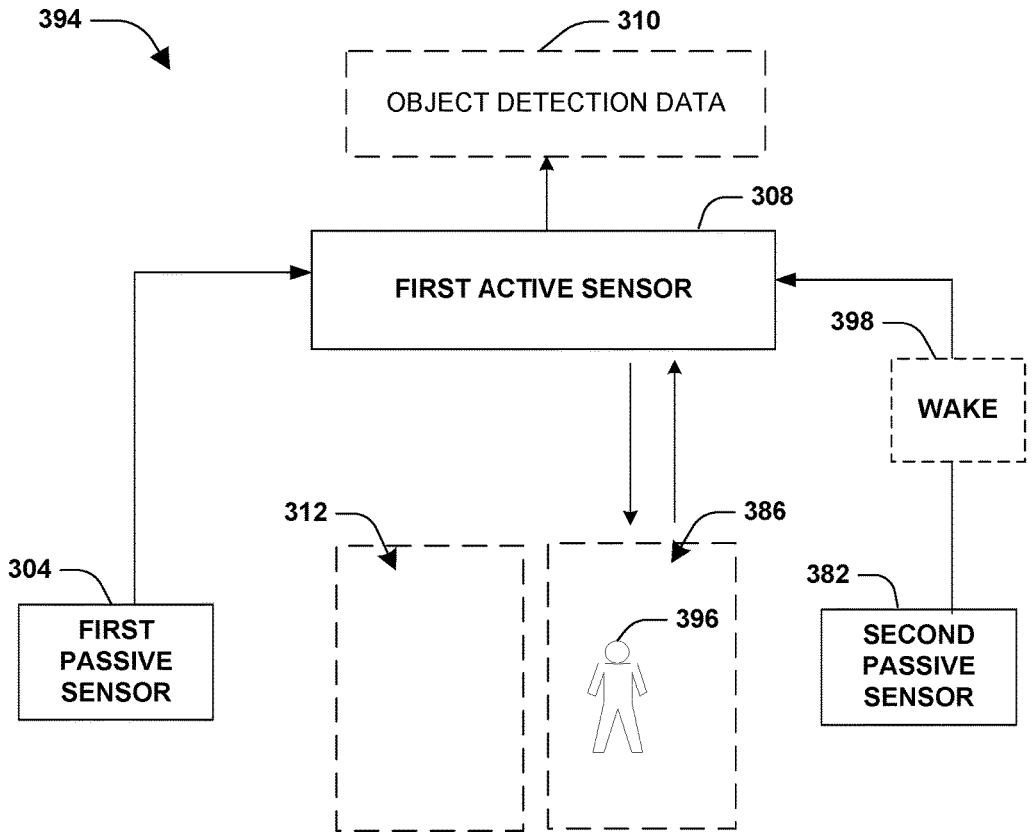
FIG. 3F is a component block diagram illustrating an exemplary sensing system for detecting an object.

It may be appreciated that a sensing system may comprise one or more passives sensors and/or one or more active sensors (e.g., a single passive sensor and multiple active sensors; multiple passive sensors and a single active sensor; a single active sensor; multiple active sensors; multiple passive sensors and multiple active sensors; etc.). In an example, a sensing system comprises the first passive sensor 304 configured to send the wakeup signal 302 to the first active sensor 308 (e.g., responsive to detecting the person 314 within the first detection zone 312), and comprises a second passive sensor 382 configured to send a wakeup signal 384 to a second active sensor 372 (e.g., responsive to detecting a second person 388 within a second detection zone 386), as illustrated in example 380 of FIG. 3D. In an example, a sensing system comprises the first passive sensor 304, the second passive sensor 382, and the first active sensor 308, as illustrated in example 390 of FIG. 3E. The first passive sensor 304 is configured to send the wakeup signal 302 to the first active sensor 308 (e.g., responsive to detecting the person 314 within the first detection zone 312), as illustrated in example 390 of FIG. 3E. The second passive sensor 382 is configured to send a wakeup signal 398 to the first active sensor 308 (e.g., responsive to detecting a person 396 within the second detection zone 386), as illustrated in example 394 of FIG. 3F.

Figure 4:
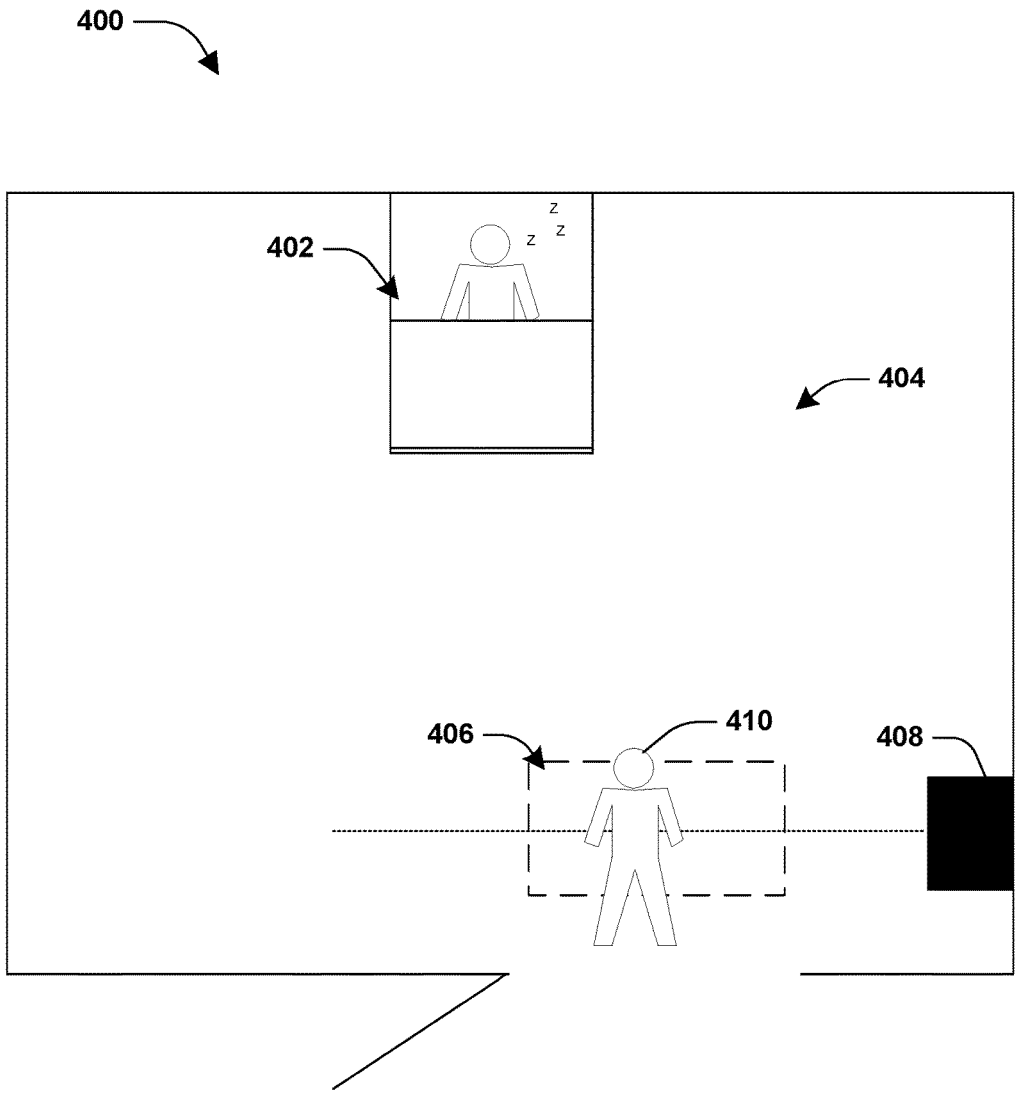
FIG. 4 is an illustration of an example of a sensing system configured within a patient's room.

FIG. 4 illustrates an example 400 of a sensing system configured within a patient's room. The patient's room may comprise a patient bed zone 402. The sensing system may comprise a first sensor arrangement 408 comprising a first passive sensor and a first active sensor. In an example, the first sensor arrangement 408 may be aimed across an entryway for the patient's room. A first detection zone 406 (e.g., a doorway zone extended across the entryway) may be defined for the sensing system (e.g., for detection) based upon a first set of detection distance metrics. In an example, a first non-detection zone 404 (e.g., non-doorway portions of the patient's room) may be defined for the sensing system (e.g., to ignore) based upon a first set of non-detection distance metrics. In another example, the first non-detection zone 404 may not be defined, but may merely correspond to areas outside of the first detection zone 406. The passive sensor of the first sensor arrangement 408 may be configured to send a wakeup signal to the active sensor of the first sensor arrangement 408 based upon detecting an object, such as a nurse 410, within the first detection zone 406. In this way, the active sensor may transition from a sleep state to an active state to detect motion and/or distance of the nurse 410 (e.g., to identify a hygiene opportunity for the nurse 410) to create object detection data before transitioning from the active state to the sleep state for power conservation.

Figure 5:
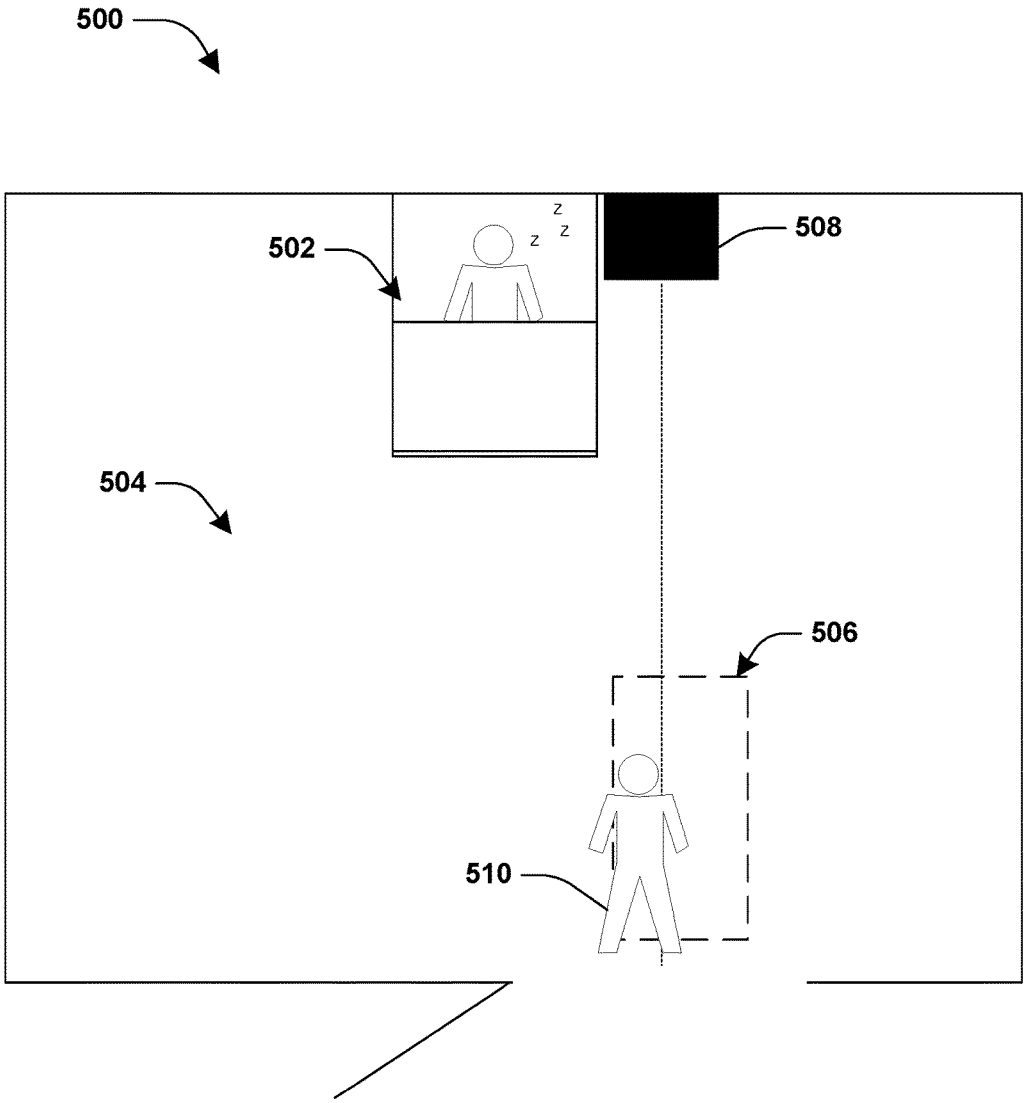
FIG. 5 is an illustration of an example of a sensing system configured within a patient's room.

FIG. 5 illustrates an example 500 of a sensing system configured within a patient's room. The patient's room may comprise a patient bed zone 502. The sensing system may comprise a first sensor arrangement 508 comprising a first passive sensor and a first active sensor. In an example, the first sensor arrangement 508 may be aimed toward an entryway for the patient's room. A first detection zone 506 (e.g., a doorway zone extending from the entryway into the patient's room) may be defined for the sensing system (e.g., for detection) based upon a first set of detection distance metrics. The sensing system may be configured to ignore a first non-detection zone 504 (e.g., non-doorway portions of the patient's room). The passive sensor of the first sensor arrangement 508 may be configured to send a wakeup signal to the active sensor of the first sensor arrangement 508 based upon detecting an object, such as a nurse 510, within the first detection zone 506. In this way, the active sensor may transition from a sleep state to an active state to detect motion and/or distance of the nurse 510 to create object detection data (e.g., to identify a hygiene opportunity for the nurse 510) before transitioning from the active state to the sleep state for power conservation.

Figure 6A:
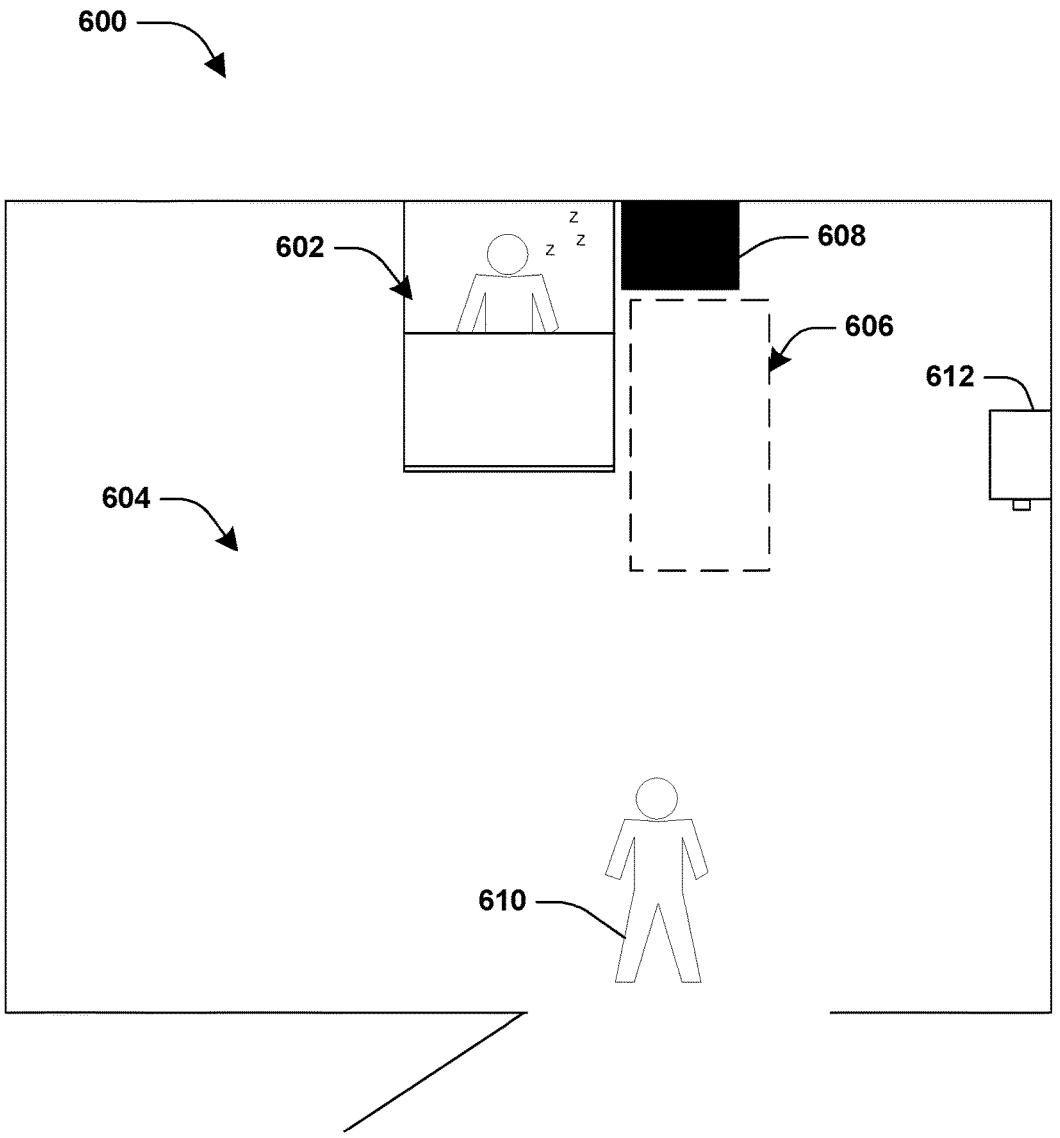
FIG. 6A is an illustration of an example of a sensing system configured within a patient's room.

FIG. 6A illustrates an example 600 of a sensing system configured within a patient's room. The patient's room may comprise a patient bed zone 602. The sensing system may comprise a first sensor arrangement 608 comprising a first passive sensor and a first active sensor. In an example, the first sensor arrangement 608 may be aimed towards a first bedside of the patient bed zone 602. A first detection zone 606 (e.g., corresponding to the first bedside of the patient bed zone 602) may be defined for the sensing system (e.g., for detection) based upon a first set of detection distance metrics. The sensing system may be configured to ignore a first non-detection zone 604 (e.g., non-first bedside portions of the patient's room, such as the patient bedside zone 602 so that movement of the patient is ignored). Because the passive sensor of the first sensor arrangement 608 does not detect an object within the first detection zone 606, the active sensor of the first sensor arrangement 608 may remain in a sleep state to conserve power consumption.

Figure 6B:
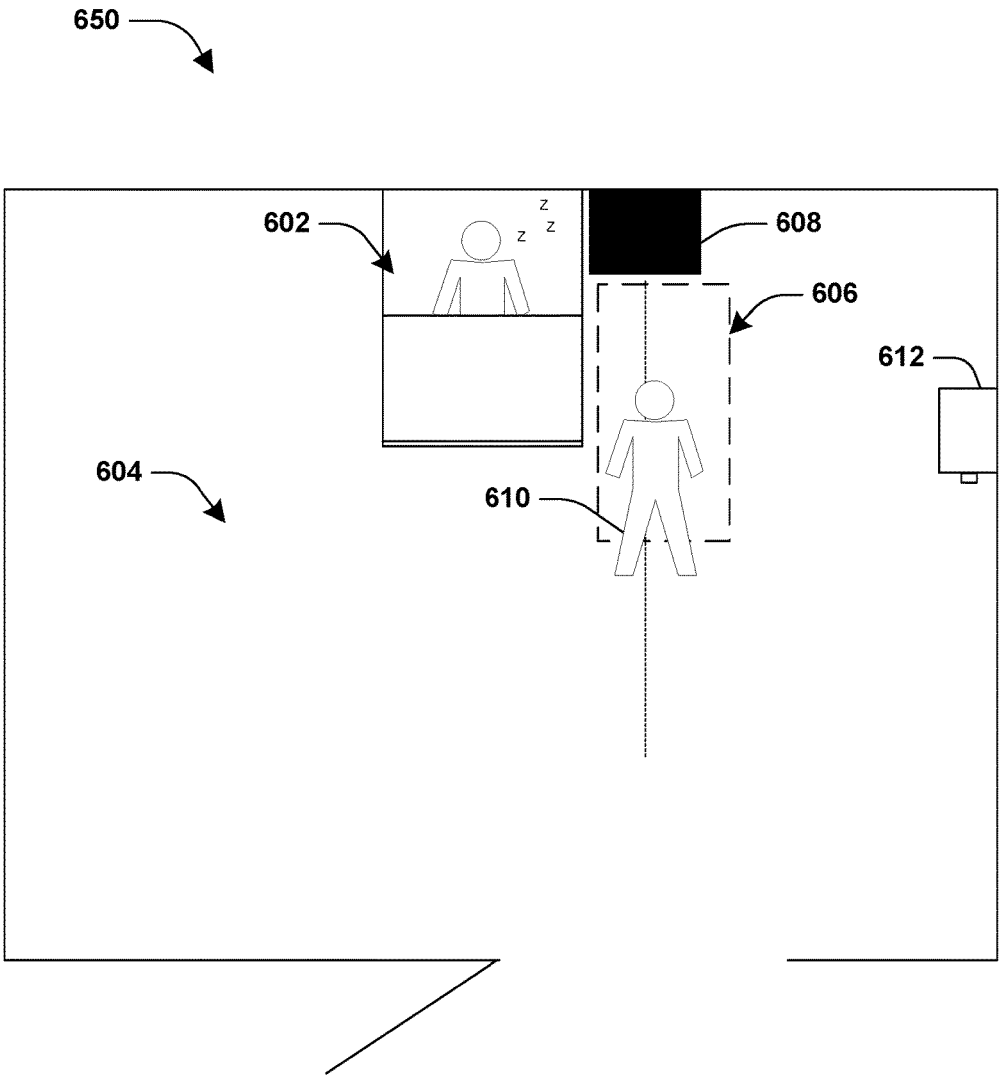
FIG. 6B is an illustration of an example of a passive sensor of a first sensor arrangement awakening an active sensor of the first sensor arrangement for detection of an object.

FIG. 6B illustrates an example 650 of a passive sensor of a first sensor arrangement 608 awakening an active sensor of the first sensor arrangement 608 for detection of an object. The passive sensor may detect an object, such as a nurse 610, within a first detection zone 606 (e.g., a first bedside of a patient bed zone 602 within a patient's room). The passive sensor of the first sensor arrangement 608 may be configured to send a wakeup signal to the active sensor based upon detecting the nurse 610. In this way, the active sensor may transition from a sleep state to an active state to detect motion and/or distance of the nurse 610 to create object detection data (e.g., to identify a hygiene opportunity for the nurse 610 to use a hygiene device 612 after interacting with a patient within the patient bed zone 602) before transitioning from the active state to the sleep state for power conservation.

Figure 7A:
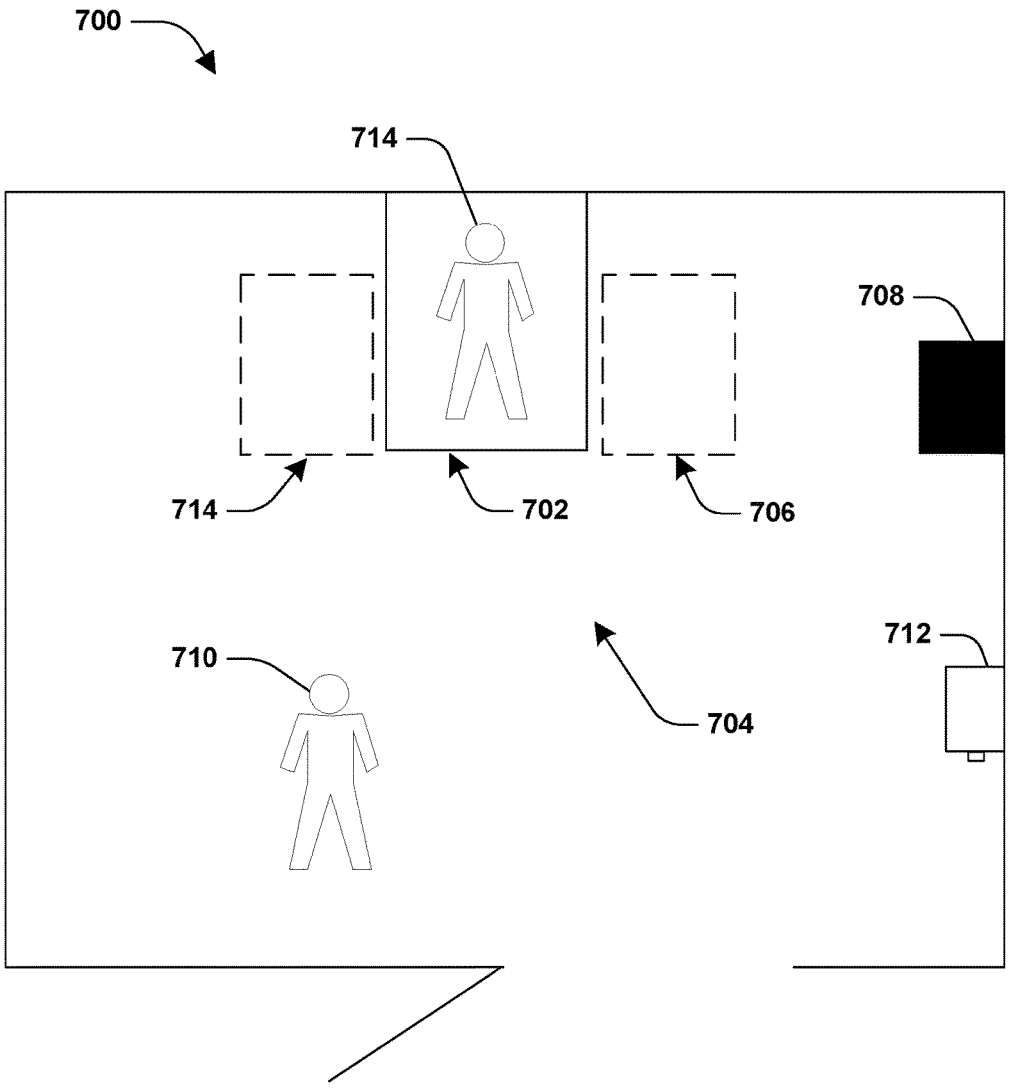
FIG. 7A is an illustration of an example of a sensing system configured within a patient's room.

FIG. 7A illustrates an example 700 of a sensing system configured within a patient's room. The patient's room may comprise a patient bed zone 702 for a patient 714. The sensing system may comprise a first sensor arrangement 708 comprising a first passive sensor and a first active sensor. In an example, the first sensor arrangement 708 may be aimed across a first bedside of the patient bed zone 702, the patient bed zone 702, and a second bedside of the patient bed zone 702. A first detection zone 706 (e.g., corresponding to the first bedside of the patient bed zone 702) may be defined for the sensing system (e.g., for detection) based upon a first set of detection distance metrics. A second detection zone 714 (e.g., corresponding to the second bedside of the patient bed zone 702) may be defined for the sensing system (e.g., for detection) based upon a second set of detection distance metrics. The sensing system may be configured to ignore a first non-detection zone 704 (e.g., non-bedside portions of the patient's room, such as the patient bedside zone 702 so that movement of the patient 714 is ignored). Because the passive sensor of the first sensor arrangement 708 does not detect an object within the first detection zone 706 and/or the second detection zone 714, the active sensor of the first sensor arrangement 708 may remain in a sleep state to conserve power consumption.

Figure 7B:
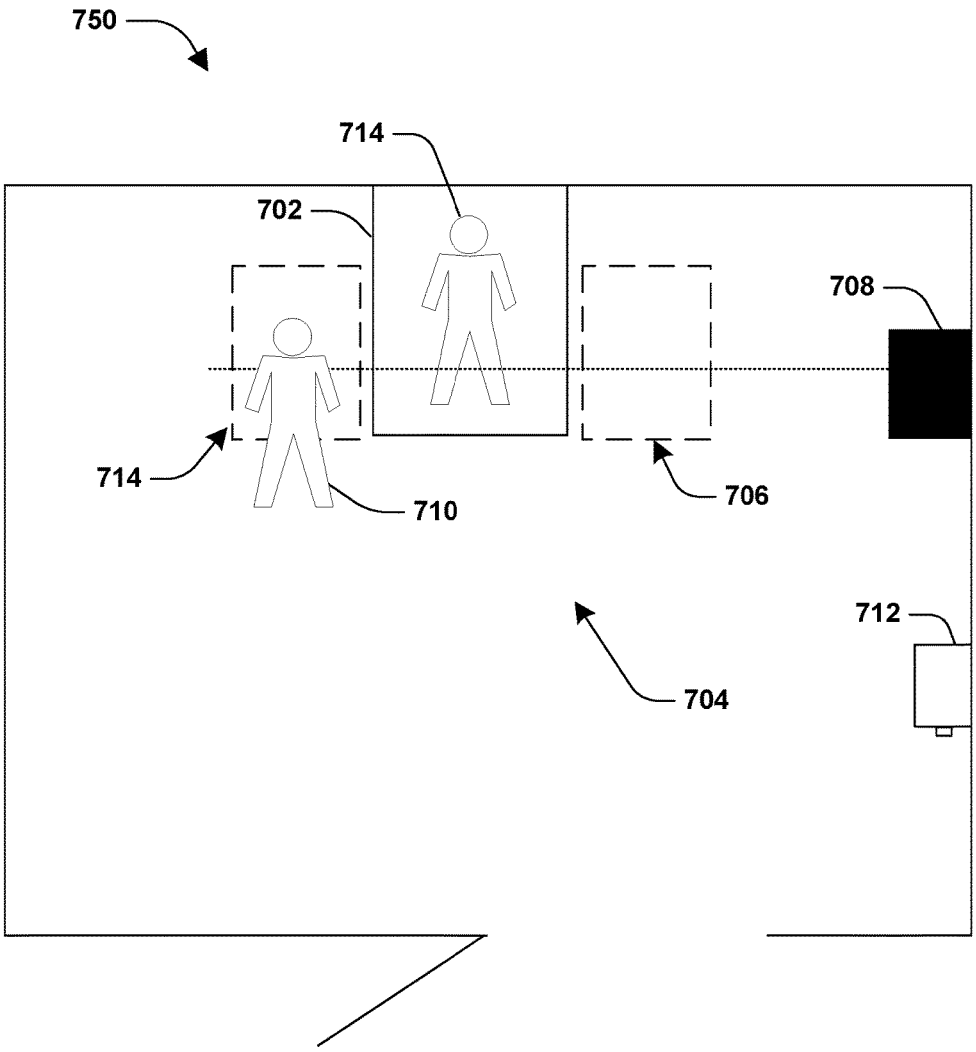
FIG. 7B is an illustration of an example of a passive sensor of a first sensor arrangement awakening an active sensor of the first sensor arrangement for detection of an object.

FIG. 7B illustrates an example 750 of a passive sensor of a first sensor arrangement 708 awakening an active sensor of the first sensor arrangement 708 for detection of an object. The passive sensor may detect an object, such as a nurse 710, within a second detection zone 714 (e.g., corresponding to a second bedside of a patient bed zone 702 within a patient's room). The passive sensor of the first sensor arrangement 708 may be configured to send a wakeup signal to the active sensor based upon detecting the nurse 710. In this way, the active sensor may transition from a sleep state to an active state to detect motion and/or distance of the nurse 710 within the second detection zone 714 to create object detection data (e.g., to identify a hygiene opportunity for the nurse 710 to use a hygiene device 712 after interacting with the patient 714) before transitioning from the active state to the sleep state for power conservation.

Figure 8A:
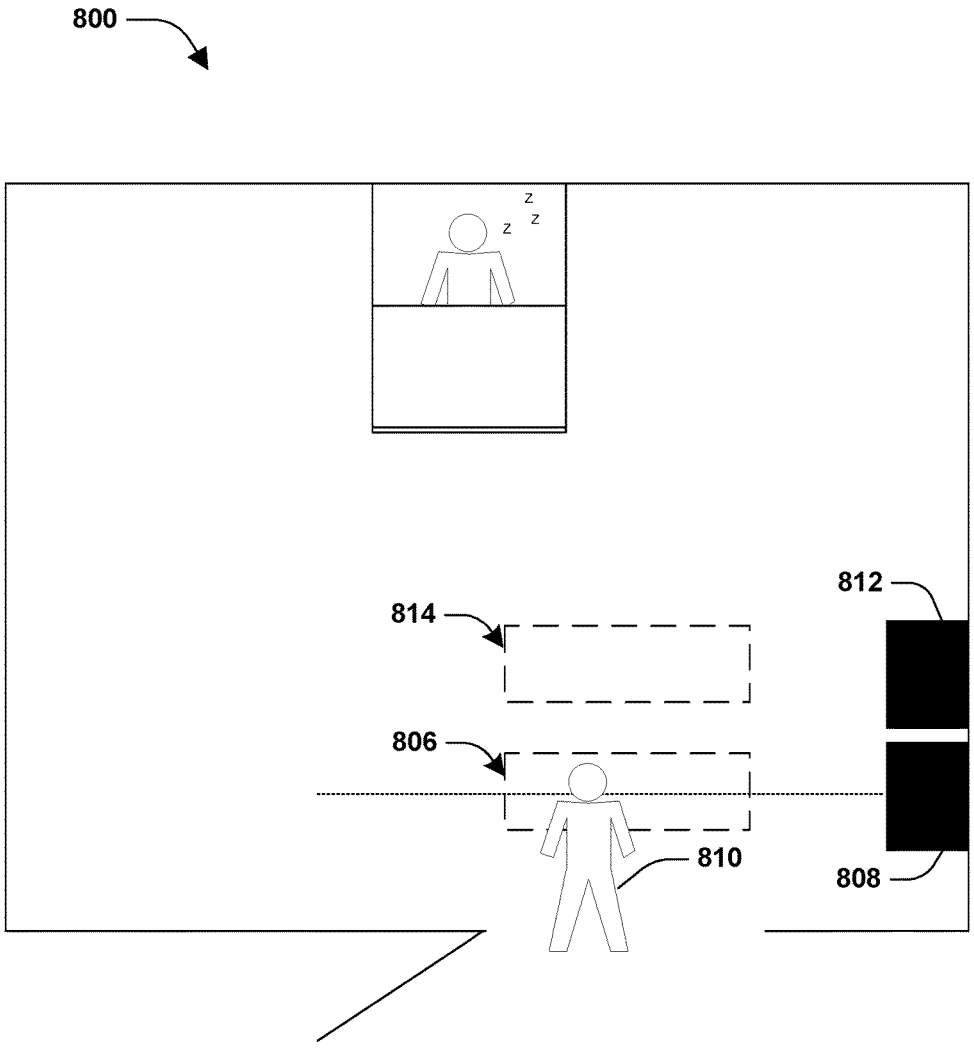
FIG. 8A is an illustration of an example of sequential detection of an object by multiple sensor arrangements.
Figure 8B:
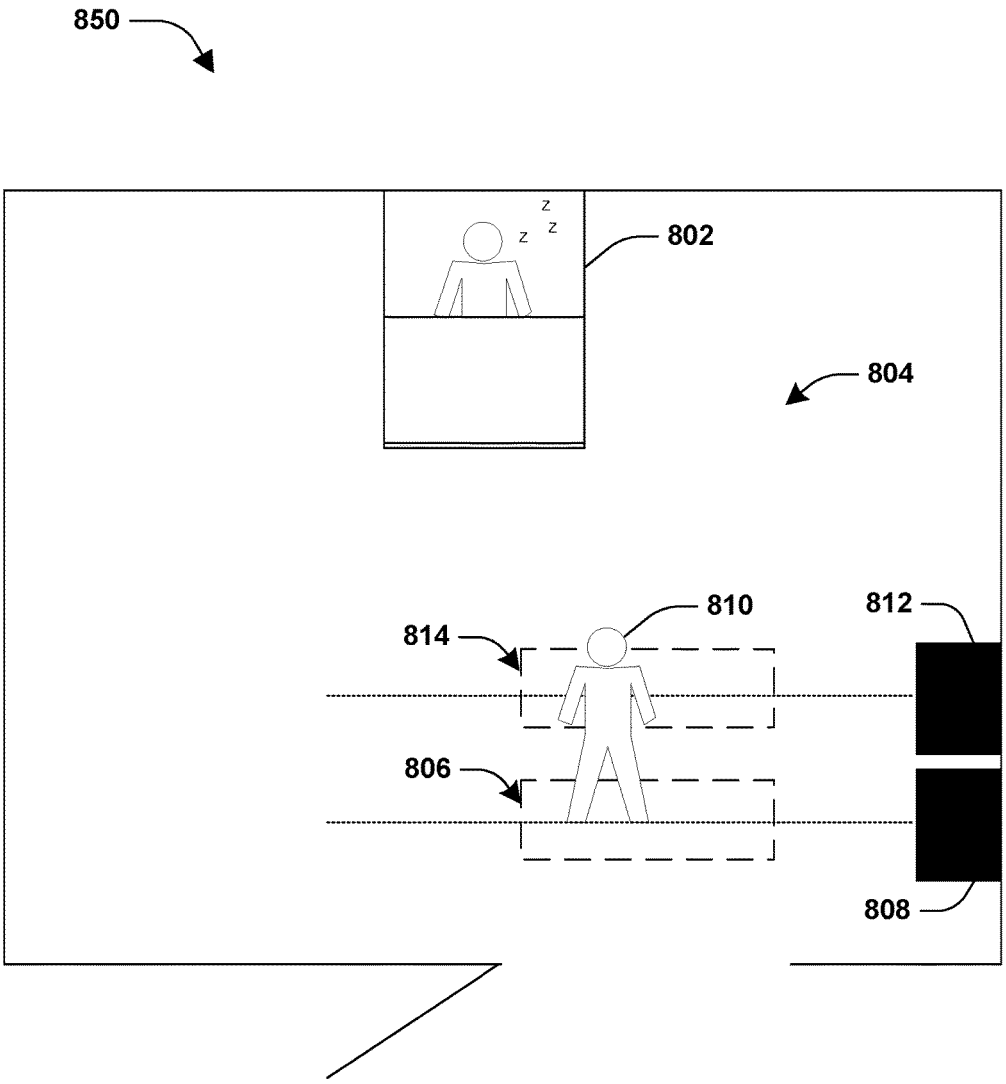
FIG. 8B is an illustration of an example of sequential detection of an object by multiple sensor arrangements.
Figure 8C:
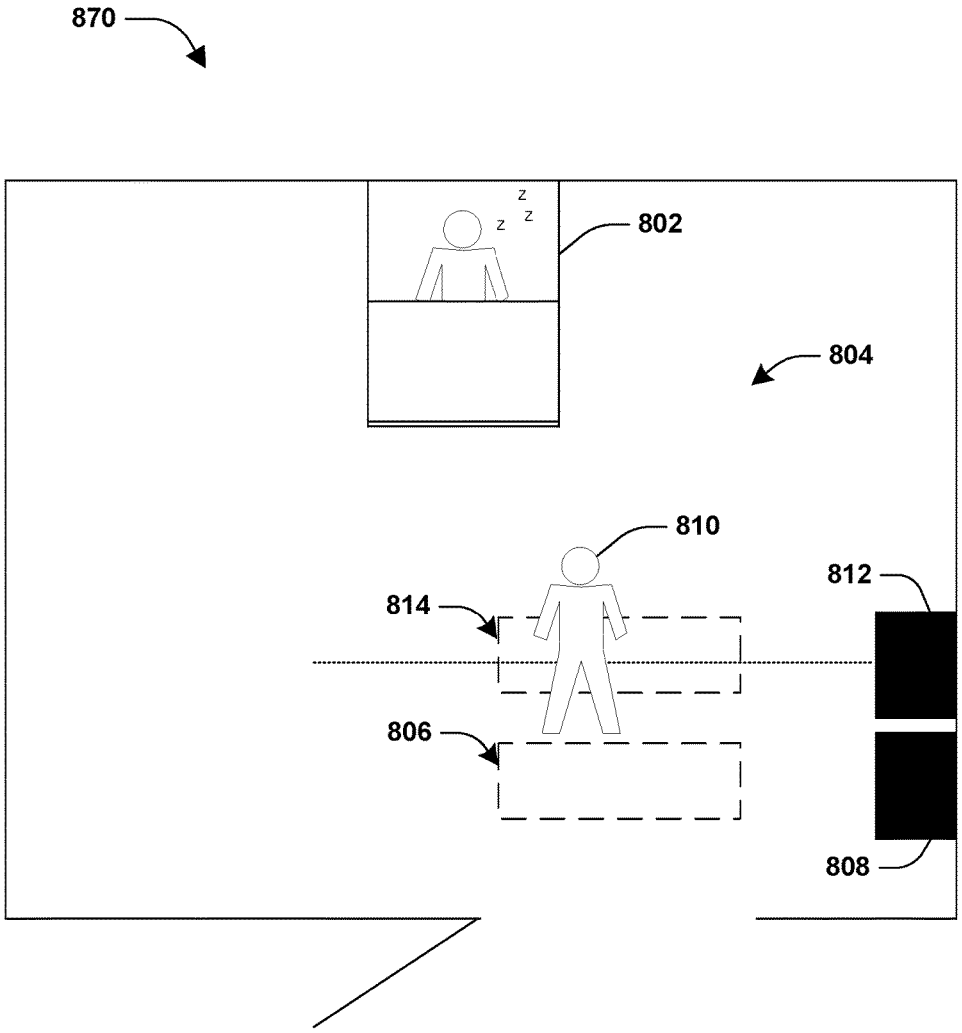
FIG. 8C is an illustration of an example of sequential detection of an object by multiple sensor arrangements.

FIGS. 8A-8C illustrate an example of sequential detection of an object by multiple sensor arrangements. A first sensor arrangement 808 and a second sensor arrangement 812 may be configured within a patient's room. The first sensor arrangement 808 may comprise a first passive sensor and/or a first active sensor. A first detection zone 806 may be defined for the first sensor arrangement 808 based upon a first set of detection distance metrics. The second sensor arrangement 812 may comprise a second passive sensor and/or a second active sensor. A second detection zone 814 may be defined for the second sensor arrangement 812 based upon a second set of detection distance metrics.

In an example, the first passive sensor may detect a presence of an object, such as a nurse 810, within the first detection zone 806, as illustrated by example 800 of FIG. 8A. The first passive sensor may send a wakeup signal to the first active sensor to detect motion and/or distance of the nurse 810 within the first detection zone 806. In an example, the nurse 810 may encounter both the first detection zone 806 and the second detection zone 814 while walking into the patient's room, as illustrated by example 850 of FIG. 8B. Accordingly, the first active sensor detects motion and/or distance of the nurse 810 within the first detection zone 806 and the second active sensor detects motion and/or distance of the nurse 810 within the second detection zone 814 (e.g., the second active sensor may begin detecting based upon a wakeup signal from the second passive sensor). In an example, the nurse 810 may encounter the second detection zone 814 but not the first detection zone 806 while walking further into the patient's room, as illustrated by example 870 of FIG. 8C. Accordingly, the second active sensor, but not the first active sensor, may detect motion and/or distance of the nurse 810 within the second detection zone 814. In this way, sequential detection of the nurse 810 entering the patient's room may be facilitated (e.g., and/or detection of the nurse 810 leaving the room).

Figure 9A:
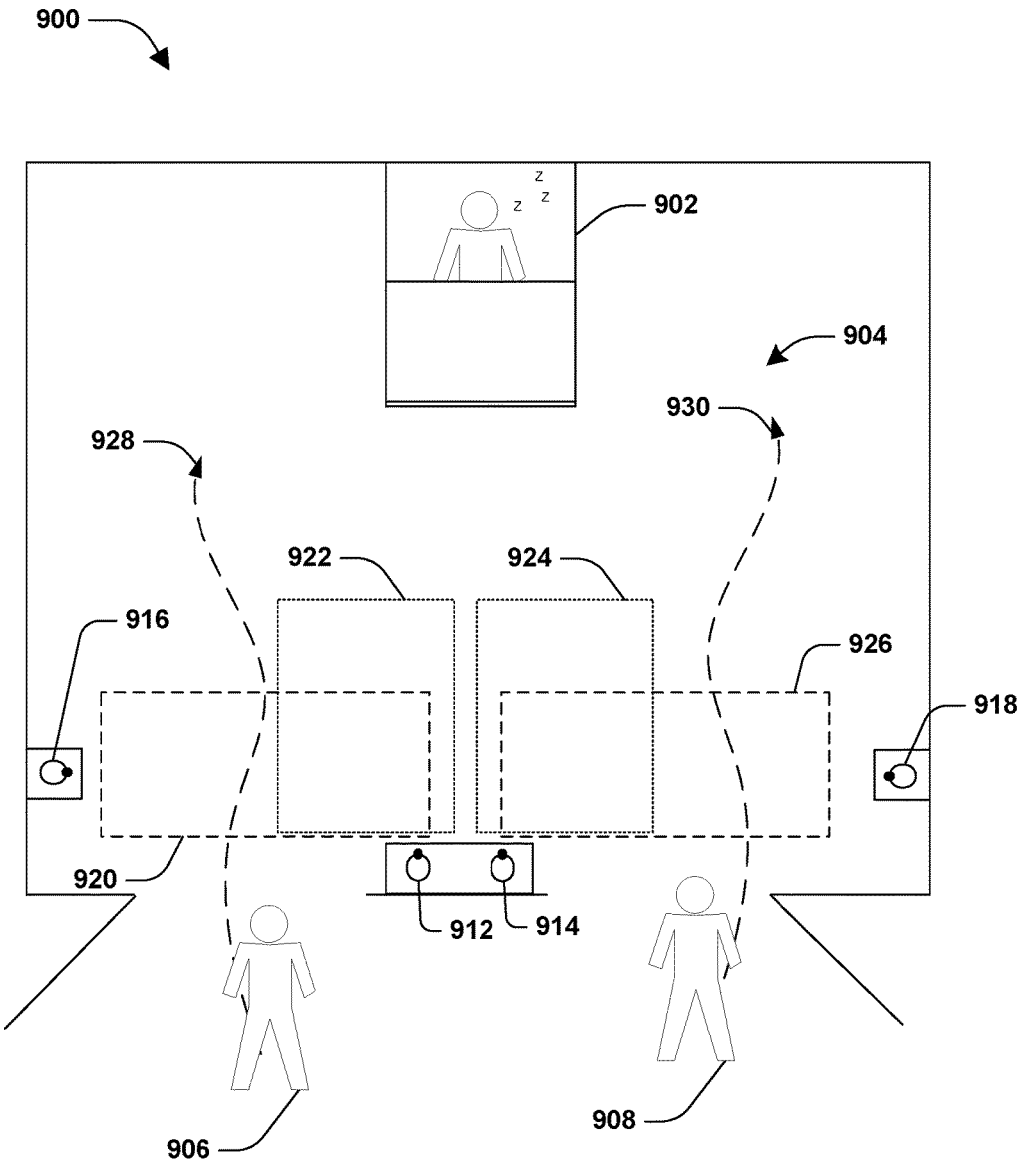
FIG. 9A is an illustration of an example of a sensing system configured according to a first field of detection configuration.
Figure 9B:
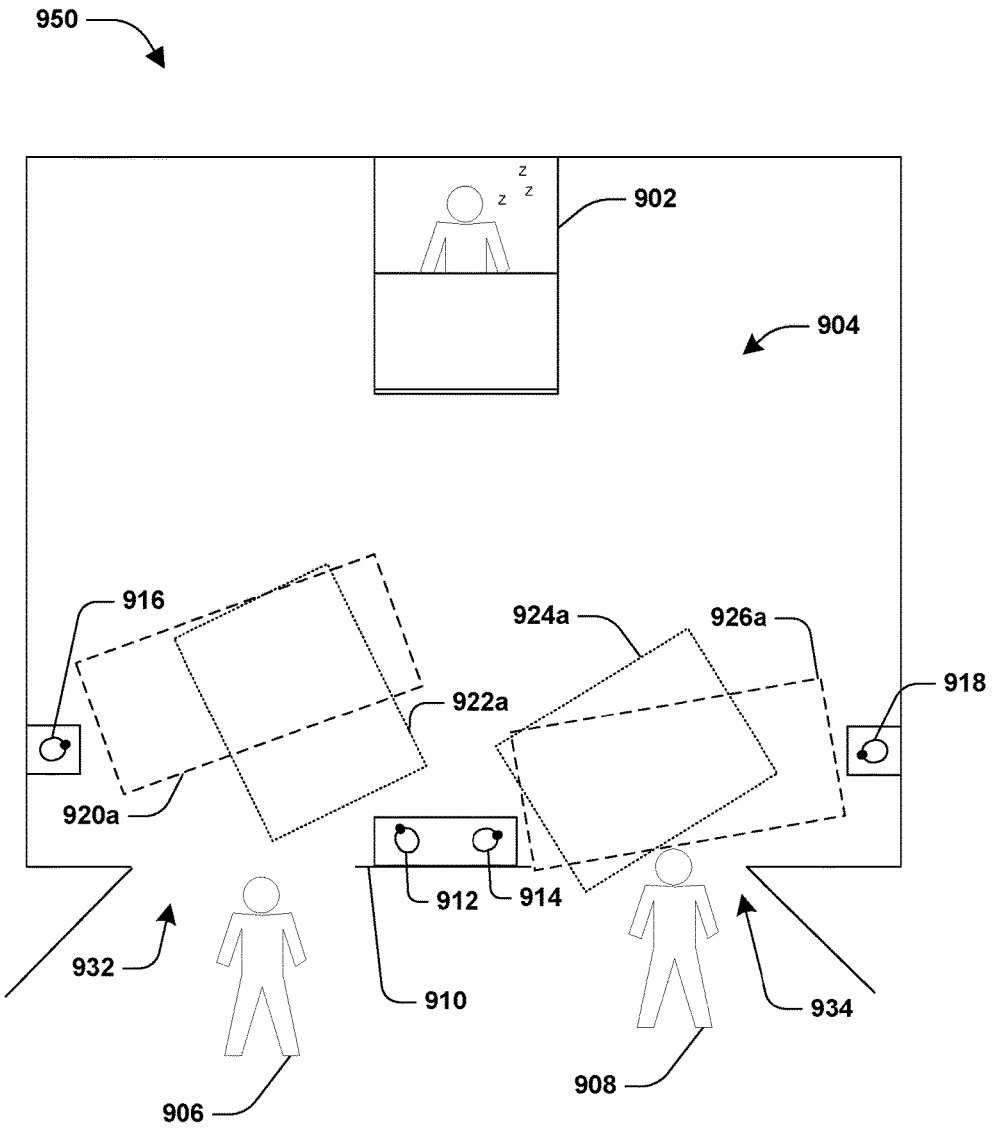
FIG. 9B is an illustration of an example of a sensing system configured according to a second field of detection configuration.

FIGS. 9A and 9B illustrate examples of a sensing system that is manually adjustable for different fields of detection. FIG. 9A illustrates an example 900 of the sensing system configured according to a first field of detection configuration. For example, a first passive sensor 912, a second passive sensor 914, a first active sensor 916, and/or a second active sensor 918 may be selectively positionable (e.g., a sensor may be manually or mechanically movable in a plurality of directions such as up/down, left/right, diagonal, etc.). For example, an installer of the sensing system may initially position the first passive sensor 912 and the second passive sensor 914 towards a patient's bed 902 within a hospital room 904. Thus, the first passive sensor 912 has a first passive detection zone 922 and the second passive sensor has a second passive detection zone 924. The installer may initially position the first active sensor 916 and the second active sensor 918 on opposite walls across from one another. Thus, the first active sensor 916 has a first active detection zone 920 and the second active sensor 918 has a second active detection zone 926.

Because the first passive sensor 912 may not detect a first user 906 walking into the hospital room 904 when the first user 906 takes a first pathway 928 (e.g., the first user 906 may walk to the left of the first passive detection zone 922), the first passive sensor 912 would not awaken the first active sensor 916 for detection of the first user 906. Because the second passive sensor 914 may not detect a second user 908 walking into the hospital room 904 when the second user 908 takes a second pathway 930 (e.g., the second user 908 may walk to the right of the second passive detection zone 924), the second passive sensor 914 would not awaken the second active sensor 918 for detection of the second user 908. Accordingly, the installer may adjust the first passive sensor 912 towards the left, resulting in an adjusted first passive detection zone 922*a* that provides greater detection coverage across a first entryway 932 than the first passive detection zone 922, as illustrated by example 950 of FIG. 9B. The installer may adjust the first active sensor 916 towards the left, resulting in an adjusted first active detection zone 920*a* that has a desired overlap with the adjusted first passive detection zone 922*a*. The installer may adjust the second passive sensor 914 towards the right, resulting in an adjusted second passive detection zone 924*a* that provides greater coverage across a second entryway 934 than the second passive detection zone 924. The installer may adjust the second active sensor 918 towards the left, resulting in an adjusted second active detection zone 926*a* that has a desired overlap with the adjusted second passive detection zone 924*a*. In this way, the sensing system may be adjusted to a second field of detection configuration. The installer may lock the sensors and/or a cover of a housing comprising the sensors to mitigate unauthorized repositioning of the sensors.

Figure 10:
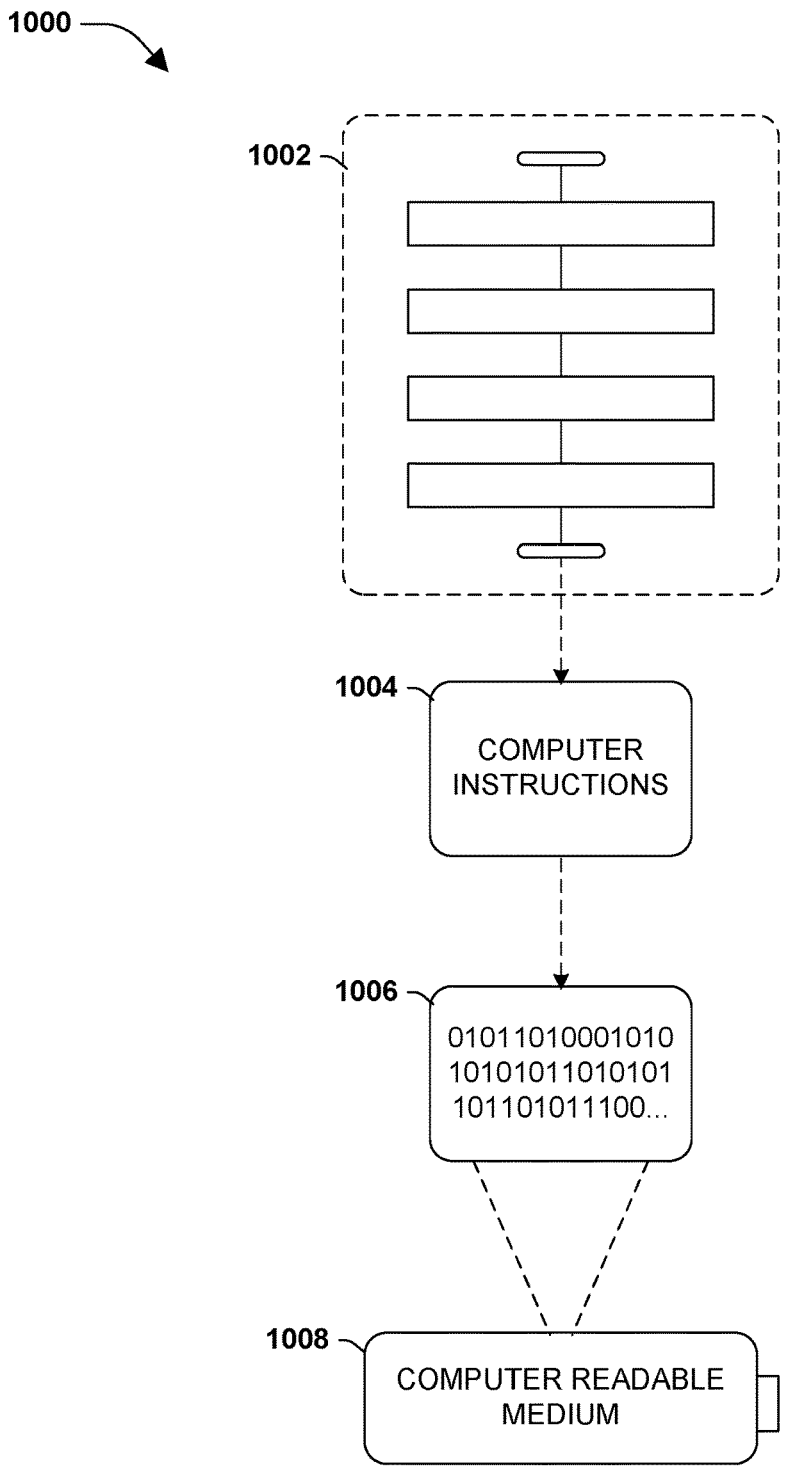
FIG. 10 is an illustration of an exemplary computer readable medium wherein processor-executable instructions configured to embody one or more of the provisions set forth herein may be comprised.

Still another embodiment involves a computer-readable medium comprising processor-executable instructions configured to implement one or more of the techniques presented herein. An example embodiment of a computer-readable medium or a computer-readable device is illustrated in FIG. 10, wherein the implementation 1000 comprises a computer-readable medium 1008, such as a CD-R, DVD-R, flash drive, a platter of a hard disk drive, etc., on which is encoded computer-readable data 1006. This computer-readable data 1006, such as binary data comprising at least one of a zero or a one, in turn comprises a set of computer instructions 1004 configured to operate according to one or more of the principles set forth herein. In some embodiments, the processor-executable computer instructions 1004 are configured to perform a method 1002, such as at least some of the exemplary method 100 of FIG. 1, for example. In some embodiments, the processor-executable instructions 1004 are configured to implement a system, such as at least some of the exemplary system 200 of FIG. 2A, at least some of the exemplary system 300 of FIG. 3A, at least some of the exemplary system 350 of FIG. 3B, and/or at least some of the exemplary system 370 of FIG. 3C, for example. Many such computer-readable media are devised by those of ordinary skill in the art that are configured to operate in accordance with the techniques presented herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing at least some of the claims.

As used in this application, the terms "component," "module," "system", "interface", and/or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, many modifications may be made to this configuration without departing from the scope or spirit of the claimed subject matter.

Figure 11:
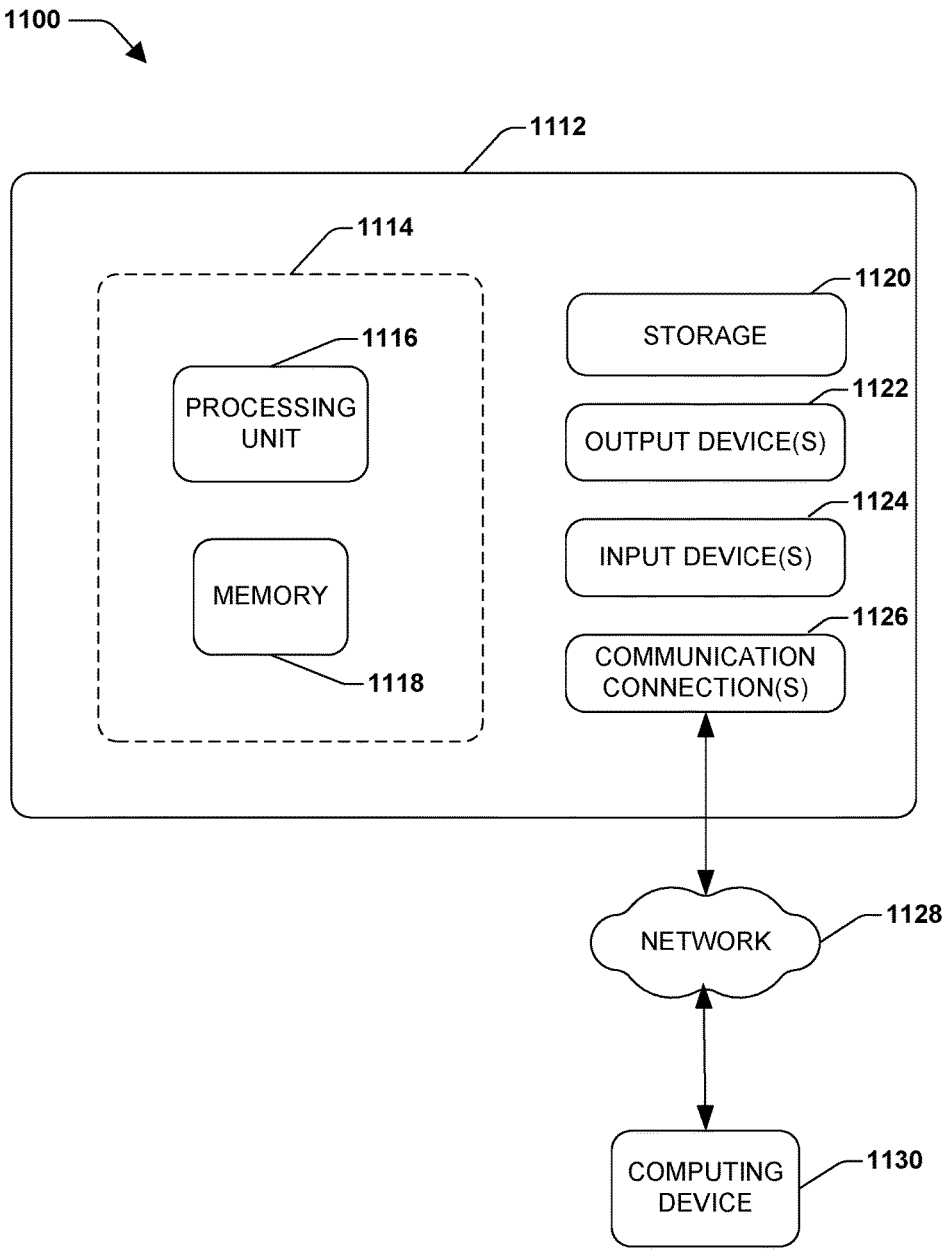
FIG. 11 illustrates an exemplary computing environment wherein one or more of the provisions set forth herein may be implemented.

FIG. 11 and the following discussion provide a brief, general description of a suitable computing environment to implement embodiments of one or more of the provisions set forth herein. The operating environment of FIG. 11 is only one example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, Personal Digital Assistants (PDAs), media players, and the like), multiprocessor systems, consumer electronics, mini computers, mainframe computers, distributed computing environments that include any of the above systems or devices, and the like.

Although not required, embodiments are described in the general context of "computer readable instructions" being executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

FIG. 11 illustrates an example of a system 1100 comprising a computing device 1112 configured to implement one or more embodiments provided herein. In one configuration, computing device 1112 includes at least one processing unit 1116 and memory 1118. Depending on the exact configuration and type of computing device, memory 1118 may be volatile (such as RAM, for example), non-volatile (such as ROM, flash memory, etc., for example) or some combination of the two. This configuration is illustrated in FIG. 11 by dashed line 1114.

In other embodiments, device 1112 may include additional features and/or functionality. For example, device 1112 may also include additional storage (e.g., removable and/or non-removable) including, but not limited to, magnetic storage, optical storage, and the like. Such additional storage is illustrated in FIG. 11 by storage 1120. In one embodiment, computer readable instructions to implement one or more embodiments provided herein may be in storage 1120. Storage 1120 may also store other computer readable instructions to implement an operating system, an application program, and the like. Computer readable instructions may be loaded in memory 1118 for execution by processing unit 1116, for example.

The term "computer readable media" as used herein includes computer storage media. Computer storage media includes volatile and nonvolatile, removable and non-removable media implemented in any method or technology for storage of information such as computer readable instructions or other data. Memory 1118 and storage 1120 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which can be used to store the desired information and which can be accessed by device 1112. Any such computer storage media may be part of device 1112.

Device 1112 may also include communication connection(s) 1126 that allows device 1112 to communicate with other devices. Communication connection(s) 1126 may include, but is not limited to, a modem, a Network Interface Card (NIC), an integrated network interface, a radio frequency transmitter/receiver, an infrared port, a USB connection, or other interfaces for connecting computing device 1112 to other computing devices. Communication connection(s) 1126 may include a wired connection or a wireless connection. Communication connection(s) 1126 may transmit and/or receive communication media.

The term "computer readable media" may include communication media. Communication media typically embodies computer readable instructions or other data in a "modulated data signal" such as a carrier wave or other transport mechanism and includes any information delivery media. The term "modulated data signal" may include a signal that has one or more of its characteristics set or changed in such a manner as to encode information in the signal.

Device 1112 may include input device(s) 1124 such as keyboard, mouse, pen, voice input device, touch input device, infrared cameras, video input devices, and/or any other input device. Output device(s) 1122 such as one or more displays, speakers, printers, and/or any other output device may also be included in device 1112. Input device(s) 1124 and output device(s) 1122 may be connected to device 1112 via a wired connection, wireless connection, or any combination thereof. In one embodiment, an input device or an output device from another computing device may be used as input device(s) 1124 or output device(s) 1122 for computing device 1112.

Components of computing device 1112 may be connected by various interconnects, such as a bus. Such interconnects may include a Peripheral Component Interconnect (PCI), such as PCI Express, a Universal Serial Bus (USB), firewire (IEEE 1394), an optical bus structure, and the like. In another embodiment, components of computing device 1112 may be interconnected by a network. For example, memory 1118 may be comprised of multiple physical memory units located in different physical locations interconnected by a network.

Those skilled in the art will realize that storage devices utilized to store computer readable instructions may be distributed across a network. For example, a computing device 1130 accessible via a network 1128 may store computer readable instructions to implement one or more embodiments provided herein. Computing device 1112 may access computing device 1130 and download a part or all of the computer readable instructions for execution. Alternatively, computing device 1112 may download pieces of the computer readable instructions, as needed, or some instructions may be executed at computing device 1112 and some at computing device 1130.

Various operations of embodiments are provided herein. In one embodiment, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment provided herein. Also, it will be understood that not all operations are necessary in some embodiments.

Further, unless specified otherwise, "first," "second," and/or the like are not intended to imply a temporal aspect, a spatial aspect, an ordering, etc. Rather, such terms are merely used as identifiers, names, etc. for features, elements, items, etc. For example, a first object and a second object generally correspond to object A and object B or two different or two identical objects or the same object.

Moreover, "exemplary" is used herein to mean serving as an example, instance, illustration, etc., and not necessarily as advantageous. As used herein, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B or both A and B. Furthermore, to the extent that "includes", "having", "has", "with", and/or variants thereof are used in either the detailed description or the claims, such terms are intended to be inclusive in a manner similar to the term "comprising".

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A sensing system for detecting an object, comprising:
a first sensor arrangement comprising:
a first passive sensor configured to:
responsive to detecting a presence of an object, send a wakeup signal to a first active sensor for triggering the first active sensor to awaken from a sleep state; and
the first active sensor configured to:
responsive to receiving the wakeup signal from the first passive sensor, transition from the sleep state to an active state; and
while in the active state:
detect at least one of motion or distance of the object within a first detection zone to create object detection data; and
responsive to a determination that the object has physically left the first detection zone, transition from the active state to the sleep state.

2. The sensing system of claim 1, the first passive sensor and the first active sensor comprised within a sensor housing.

3. The sensing system of claim 1, the first passive sensor comprised within a first sensor housing and the first active sensor comprised within a second sensor housing.

4. The sensing system of claim 1, the first passive sensor configured to transmit the wakeup signal as a radio frequency (RF) signal to the first active sensor.

5. The sensing system of claim 1, the first sensor arrangement configured to
identify a hygiene opportunity based upon the object detection data.

6. The sensing system of claim 1, the first sensor arrangement configured to at least one of:
store the object detection data within data storage;
transmit the object detection data over a communication network;
transmit the object detection data as an RF signal; or
activate an indicator.

7. The sensing system of claim 1, the first active sensor configured to:
ignore a non-detection zone defined based upon a first set of non-detection distance metrics.

8. The sensing system of claim 1, wherein motion is detected within the first detection zone to create object detection data.

9. The sensing system of claim 1, the first active sensor configured to:
define the first detection zone based upon a first set of detection distance metrics.

10. The sensing system of claim 9, the first detection zone comprising at least one of a bedside zone, a doorway zone, a hygiene zone, or a hygiene opportunity zone.

11. The sensing system of claim 1, the first active sensor configured to:
define a second detection zone based upon a second set of detection distance metrics.

12. The sensing system of claim 11, the first detection zone corresponding to a first bedside zone of a bed, the second detection zone corresponding to a second bedside zone of the bed, and a non-detection zone corresponding to a patient bed zone.

13. The sensing system of claim 1, the first sensor arrangement comprising:
a second active sensor configured to:
responsive to receiving a second wakeup signal from the first passive sensor, transition from a second sleep state to a second active state; and
while in the second active state:
detect at least one of second motion or second distance of the object within a second detection zone to create second object detection data; and
responsive to at least one of a second detection timeout or a second determination that the object has left the second detection zone, transition from the second active state to the second sleep state.

14. The sensing system of claim 13, the first active sensor and the second active sensor configured to sequentially detect the object to determine whether the object is entering an area or leaving the area.

15. The sensing system of claim 1, the first sensor arrangement powered by a battery.

16. A method for detecting an object, comprising:

invoking a first passive sensor to:

responsive to detecting a presence of an object, send a wakeup signal to a first active sensor for triggering the first active sensor to awaken from a sleep state; and invoking the first active sensor to:

responsive to receiving the wakeup signal from the first passive sensor, transition from the sleep state to an active state; and while in the active state:

detect at least one of motion or distance of the object within a first detection zone to create object detection data; and responsive to a determination that the object has physically left the first detection zone, transition from the active state to the sleep state.

17. The method of claim 16, comprising:

identifying a hygiene opportunity based upon the object detection data.

18. A sensing system for detecting an object, comprising:

a first sensor configured to:

responsive to detecting a presence of an object, send a first wakeup signal to a second sensor and send a second wakeup signal to a third sensor;

the second sensor configured to:

transition from a first sleep state to a first active state based upon the first wakeup signal received from the first sensor; and while in the first active state, detect at least one of first motion or first distance of the object within a first detection zone to create first object detection data; and the third sensor configured to:

transition from a second sleep state to a second active state based upon the second wakeup signal received from the first sensor; and while in the second active state, detect at least one of second motion or second distance of the object within a second detection zone to create second object detection data, wherein the first object detection data and the second object detection data are jointed used to determine whether an object is entering an area or leaving the area.

19. The sensing system of claim 18, the first sensor and the second sensor comprised within a sensor housing.

20. The sensing system of claim 18, the first sensor comprised within a first sensor housing and the second sensor comprised within a second sensor housing remotely located away from the first sensor housing.

* * * * *